US012704317B2

(12) United States Patent
Pizzi et al.

(10) Patent No.: US 12,704,317 B2
(45) Date of Patent: Aug. 11, 2026

(54) REFRIGERATED CABINET

(71) Applicant: True Manufacturing Co., Inc., O'Fallon, MO (US)

(72) Inventors: Christian Pizzi, O'Fallon, MO (US); Christopher Moonier, O'Fallon, MO (US); Brandon Clay, O'Fallon, MO (US); John Friend, O'Fallon, MO (US)

(73) Assignee: TRUE MANUFACTURING CO., INC., O'fallon, MO (US)

( * ) Notice: Subject to any disclaimer, the term of this patent is extended or adjusted under 35 U.S.C. 154(b) by 200 days.

(21) Appl. No.: 18/401,840

(22) Filed: Jan. 2, 2024

(65) Prior Publication Data

US 2024/0219107 A1 Jul. 4, 2024

Related U.S. Application Data

(63) Continuation of application No. PCT/US2023/086504, filed on Dec. 29, 2023.

(60) Provisional application No. 63/485,276, filed on Feb. 16, 2023, provisional application No. 63/477,978, filed on Dec. 30, 2022.

(51) Int. Cl.
*F25D 23/06* (2006.01)

(52) U.S. Cl.
CPC ..... *F25D 23/066* (2013.01); *F25D 23/062* (2013.01); *F25D 2201/10* (2013.01)

(58) Field of Classification Search
CPC .... F25D 23/062; F25D 23/066; F25D 23/085; F25D 23/087; F25D 23/082
See application file for complete search history.

(56) References Cited

U.S. PATENT DOCUMENTS 2,527,932 A 10/1950 Iwashita
3,915,328 A * 10/1975 Hawes ..... F25D 23/085 52/459
4,469,383 A * 9/1984 Losert ..... E05C 19/161 49/478.1

(Continued)

FOREIGN PATENT DOCUMENTS

DE 102015007277 A1 12/2016

OTHER PUBLICATIONS

International Search Report and Written Opinion from PCT Application No. PCT/US23/86504, mailed Jun. 21, 2024, 28 pages.

*Primary Examiner* — Daniel J Rohrhoff
(74) *Attorney, Agent, or Firm* — Stinson LLP

(57) ABSTRACT

A refrigerated cabinet is equipped with a thermal breaker between the cabinet liner and wrapper. The cabinet can operate at the −10° F. (−23° C.) set point in ambient conditions of at least 90° F. (32° C.) and at least 70% relative humidity without door frame condensation. A cabinet door gasket can have an inner sealing element that seals against the thermal breaker and an outer sealing element that seals seal against the wrapper. The wrapper can have a double return flange nested in an outer interface of the thermal breaker. The thermal breaker can hold a door frame heater inboard of a magnetic contact region with the door gasket. The frame heater can be located so that only plastic material is directly in front of the frame heater. Corner joiner elements can be ultrasonically welded to the thermal breaker to join four thermal breaker pieces together at mitered joints.

20 Claims, 31 Drawing Sheets

(56) References Cited

U.S. PATENT DOCUMENTS

| | | | | |
|---|---|---|---|---|
| 4,732,432 | A * | 3/1988 | Keil | F25D 23/082 220/592.06 |
| 5,876,104 | A * | 3/1999 | Kunkel | F25D 23/085 220/592.25 |
| 6,056,383 | A * | 5/2000 | Banicevic | F25D 23/082 312/401 |
| 6,178,763 | B1 * | 1/2001 | Brancheau | F25D 23/085 219/536 |
| 6,655,766 | B2 * | 12/2003 | Hodges | F25D 23/085 49/478.1 |
| 9,879,900 | B1 | 1/2018 | Ammerman et al. | |
| 2005/0120728 | A1 | 6/2005 | Carter | |
| 2017/0108266 | A1 * | 4/2017 | Kim | F25D 23/061 |
| 2018/0112906 | A1 | 4/2018 | Yi et al. | |
| 2020/0132359 | A1 * | 4/2020 | Amorim | B29C 45/0046 |
| 2021/0231361 | A1 * | 7/2021 | Celik | F25D 23/085 |
| 2023/0251026 | A1 * | 8/2023 | Chhajed | F25D 23/087 312/406 |
| 2024/0219108 | A1 * | 7/2024 | Pizzi | F25D 23/087 |

* cited by examiner

REFRIGERATED CABINET

CROSS-REFERENCE TO RELATED APPLICATIONS

This patent application is a continuation of International PCT Application No. PCT/US2023/86504 and claims the benefit of U.S. Provisional Patent Application No. 63/477,978, filed Dec. 30, 2022, and U.S. Provisional Patent Application No. 63/485,276, filed Feb. 16, 2023, each of which is hereby incorporated by reference in its entirety for all purposes.

FIELD

This disclosure generally pertains to a refrigerated cabinet, more particularly a refrigerated cabinet that is configured to achieve sub-freezing internal temperatures at a range of ambient conditions without condensation forming on the cabinet.

BACKGROUND

A known problem in the field of refrigerated cabinets is condensation forming on metal exterior surfaces. Condensation forms when metal exterior surfaces are cooled below the ambient dew point temperature. This commonly occurs near the cabinet's door frame, where there is usually some degree of thermal communication with the chilled interior of the cabinet. Various strategies have been employed to mitigate condensation near the door frame. For example, it is common to provide a non-metal thermal break along the door frame between a metal exterior cabinet wrapper and the internal liner. It is also common to use door frame heaters to keep the temperature of the door frame elevated above the dew point. The inventors believe it is possible to improve on prior efforts to mitigate condensation near refrigerated cabinet door frames.

SUMMARY

In one aspect, a refrigerated cabinet comprises a cabinet body defining an interior and having a door frame defining a doorway for providing access to the interior from an exterior of the refrigerated cabinet. The cabinet body comprises a wrapper having a front edge margin adjacent the doorway. A liner has a front edge margin adjacent the doorway. A thermal breaker has an outer interface connected to the front edge margin of the wrapper and an inner interface connected to the front edge margin of the liner whereby the thermal breaker connects the front edge margin of the wrapper to the front edge margin of the liner and provides a thermal break between the front edge margin of the wrapper and the front edge margin of the liner. A door is connected to the cabinet body for movement in relation to the cabinet body between an opened position and a closed position. The door comprises a gasket configured to seal against the door frame in the closed position. The gasket comprises an inner sealing element and an outer sealing element. The inner sealing element is configured to seal against the thermal breaker and the outer sealing element is configured to seal against the front edge margin of the wrapper when the door is in the closed position.

In another aspect, a refrigerated cabinet comprises a cabinet body defining an interior and having a door frame defining a doorway for providing access to the interior from an exterior of the refrigerated cabinet. A door is connected to the cabinet body for movement in relation to the cabinet body between an opened position and a closed position. The door comprises a gasket configured to seal against the door frame in the closed position. A refrigeration system is configured to maintain a −10° F. (−23° C.) set point in the interior of the cabinet body. The refrigerated cabinet is configured to operate at the −10° F. (−23° C.) set point in ambient conditions of at least 90° F. (32° C.) and at least 70% relative humidity. The refrigerated cabinet is configured to prevent condensation from forming at the door frame when the refrigeration system maintains the −10° F. (−23° C.) set point in ambient conditions of at least 90° F. (32° C.) and at least 70% relative humidity without heating the door frame, or the refrigerated cabinet is configured to prevent condensation from forming at the door frame when the refrigeration system maintains the −10° F. (−23° C.) set point in ambient conditions of at least 90° F. (32° C.) and at least 70% relative humidity with a frame heater imparting 1.7 W/ft (5.6 W/m) to the door frame at a 50% duty cycle.

In another aspect, a refrigerated cabinet comprises a cabinet body defining an interior and having a door frame defining a doorway for providing access to the interior from an exterior of the refrigerated cabinet. The cabinet body comprises a wrapper having a front edge margin adjacent the doorway. The front edge margin includes a double return flange. A liner has a front edge margin adjacent the doorway. A thermal breaker has an outer interface connected to the front edge margin of the wrapper and an inner interface connected to the front edge margin of the liner whereby the thermal breaker connects the front edge margin of the wrapper to the front edge margin of the liner and provides a thermal break between the front edge margin of the wrapper and the front edge margin of the liner. A door is connected to the cabinet body for movement in relation to the cabinet body between an opened position and a closed position. The door comprises a gasket configured to seal against the door frame in the closed position. The outer interface comprises a channel receiving the double return flange such that the double return flange nests within the channel.

In another aspect, a refrigerated cabinet comprises a cabinet body defining an interior and having a door frame defining a doorway for providing access to the interior from an exterior of the refrigerated cabinet. The door frame has a magnetic contact region. The cabinet body comprises a wrapper having a front edge margin adjacent the doorway. A liner has a front edge margin adjacent the doorway. A thermal breaker has an outer interface connected to the front edge margin of the wrapper and an inner interface connected to the front edge margin of the liner whereby the thermal breaker connects the front edge margin of the wrapper to the front edge margin of the liner and provides a thermal break between the front edge margin of the wrapper and the front edge margin of the liner. A door is connected to the cabinet body for movement in relation to the cabinet body between an opened position and a closed position. The door comprises a magnetic gasket configured to seal against the door frame in the closed position. The magnetic gasket comprises a magnet configured to magnetically adhere to the magnetic contact region of the door frame when the door is in the closed position. A frame heater is captured between the front edge margin of the wrapper and the outer interface of the thermal breaker. The frame heater is inboard of the magnetic contact region.

In another aspect, a refrigerated cabinet comprises a cabinet body defining an interior and having a door frame defining a doorway for providing access to the interior from an exterior of the refrigerated cabinet. The cabinet body comprises a wrapper having a front edge margin adjacent the doorway. A liner has a front edge margin adjacent the doorway. A plastic thermal breaker has an outer interface connected to the front edge margin of the wrapper and an inner interface connected to the front edge margin of the liner whereby the plastic thermal breaker connects the front edge margin of the wrapper to the front edge margin of the liner and provides a thermal break between the front edge margin of the wrapper and the front edge margin of the liner. A door is connected to the cabinet body for movement in relation to the cabinet body between an opened position and a closed position. The door comprises a gasket configured to seal against the door frame in the closed position. A frame heater is held by the plastic thermal breaker such that the door frame only has plastic material directly in front of the frame heater.

In another aspect, a refrigerated cabinet comprises a cabinet body defining an interior and having a door frame defining a doorway for providing access to the interior from an exterior of the refrigerated cabinet. The cabinet body comprises a wrapper having a front edge margin adjacent the doorway. A liner has a front edge margin adjacent the doorway. A plastic thermal breaker has an outer interface connected to the front edge margin of the wrapper and an inner interface connected to the front edge margin of the liner whereby the plastic thermal breaker connects the front edge margin of the wrapper to the front edge margin of the liner and provides a thermal break between the front edge margin of the wrapper and the front edge margin of the liner. The thermal breaker comprises four thermal breaker pieces connected at four corners of the thermal breaker. A corner joiner element is at each of the four corners. Each corner joiner element comprises a first section along a first one of the thermal breaker pieces and a second section along a second one of the thermal breaker pieces. The first section of each corner joiner element is fused to the respective first thermal breaker piece and the second section of each corner joiner element is fused to the respective second thermal breaker piece.

In another aspect, a method of making a refrigerated cabinet comprises forming four thermal breaker pieces and joining the four thermal breaker pieces together at four corner joints by ultrasonic welding.

Other aspects and features will be apparent hereinafter.

BRIEF DESCRIPTION OF THE DRAWINGS

Corresponding parts are given corresponding reference characters throughout the drawings.

DETAILED DESCRIPTION

Figure 1:
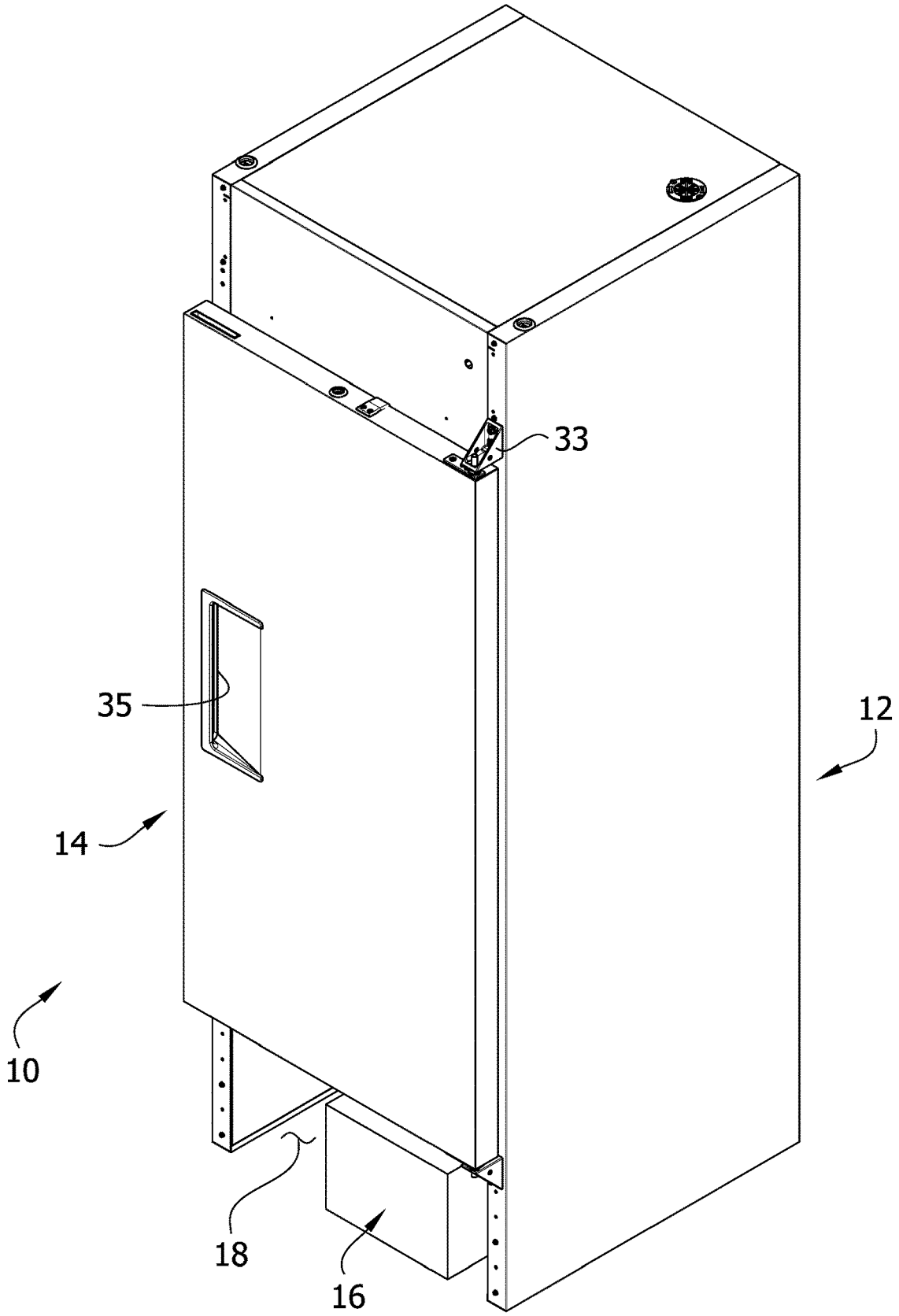
FIG. 1 is a perspective of a refrigerated cabinet.
Figure 2:
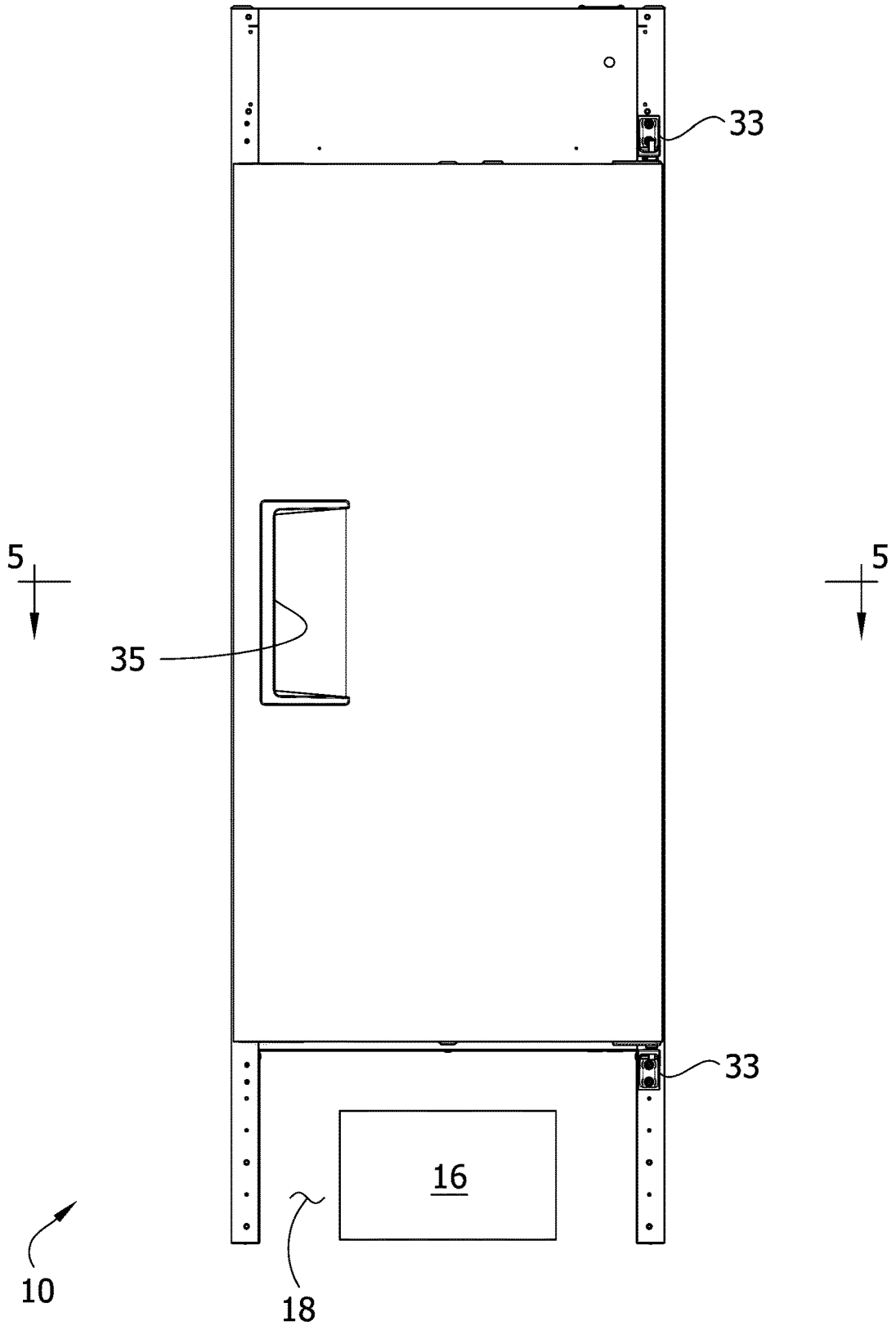
FIG. 2 is a front elevation of the refrigerated cabinet.
Figure 3:
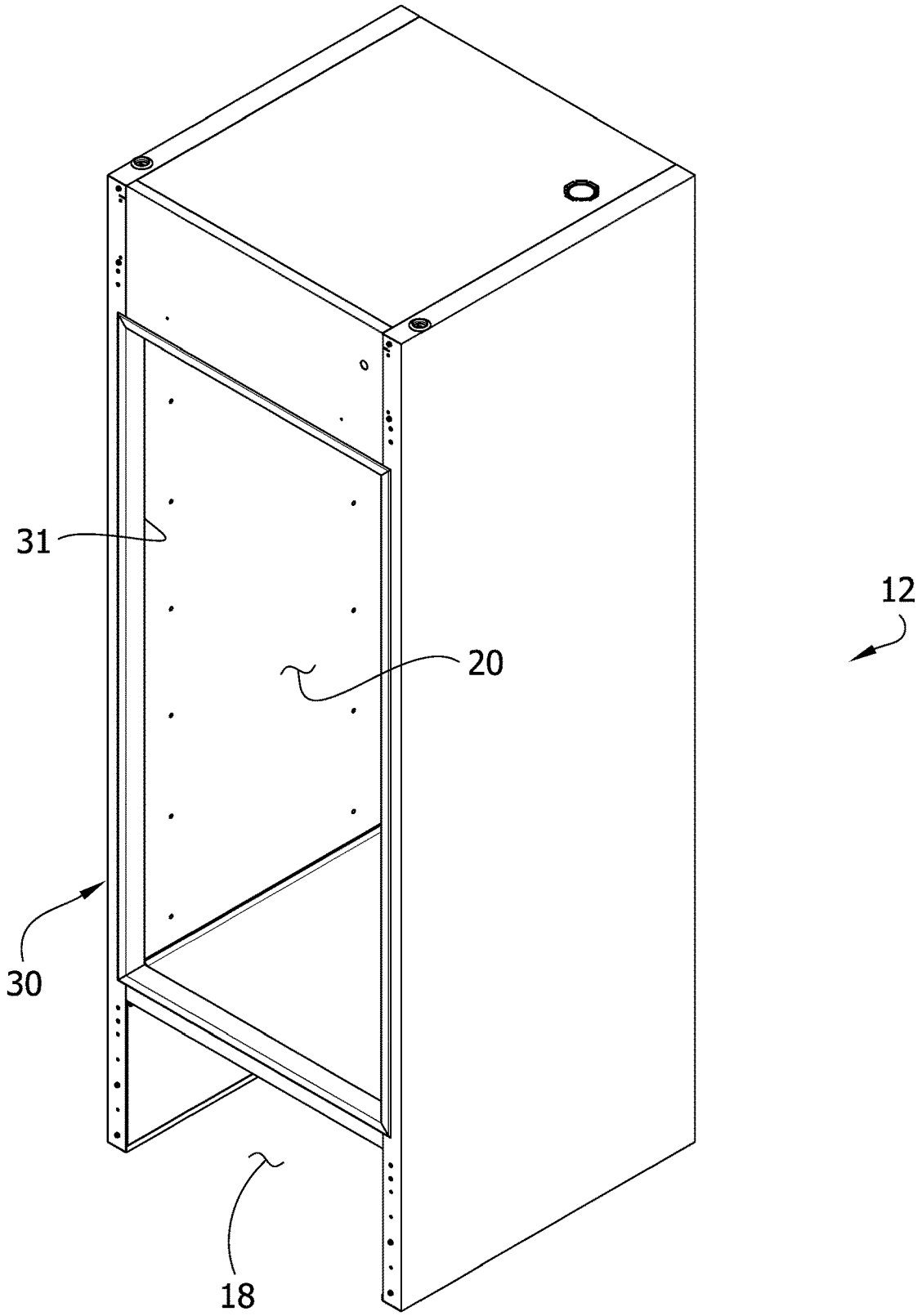
FIG. 3 is a perspective of a cabinet body of the refrigerated cabinet.
Figure 4:
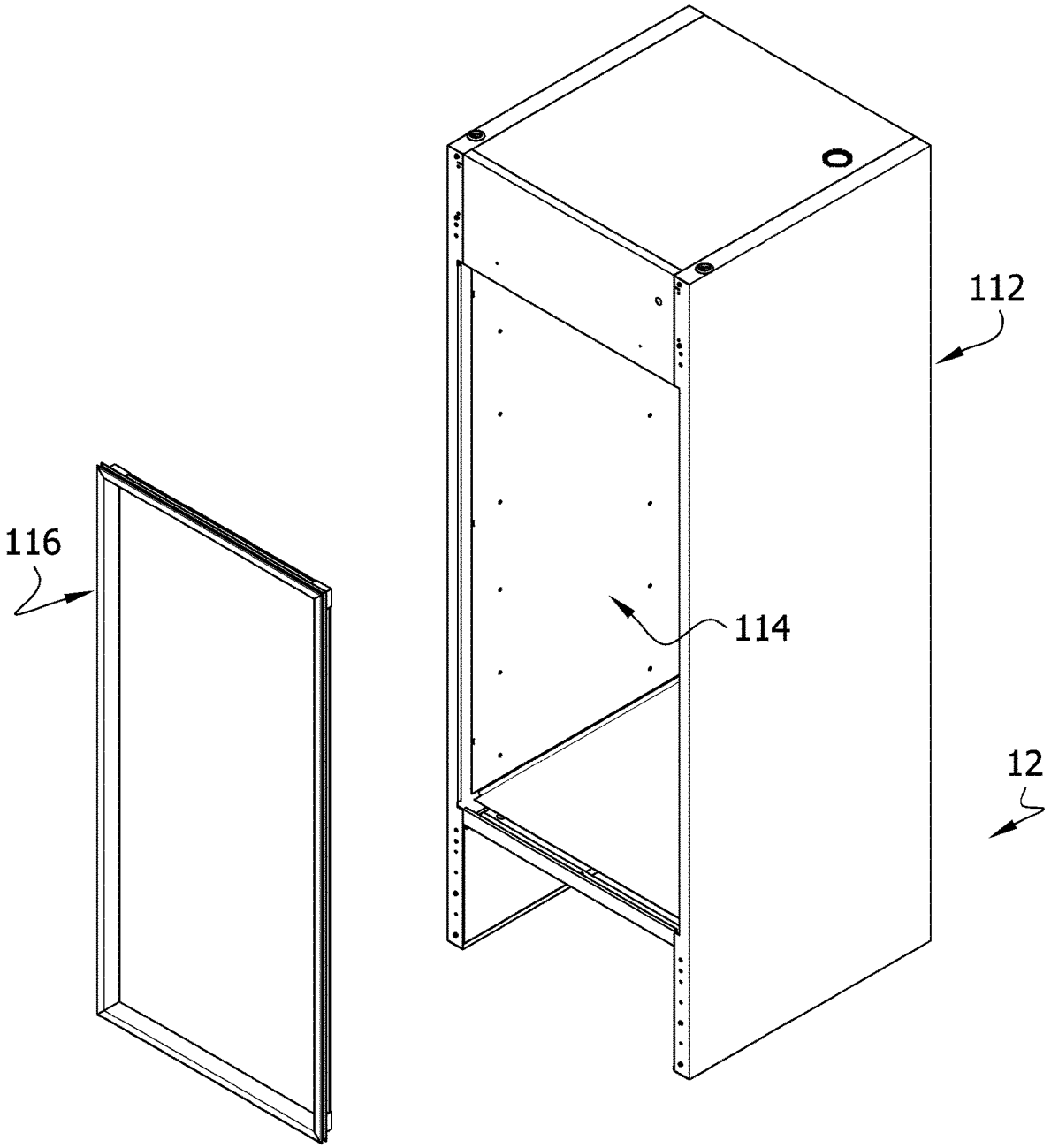
FIG. 4 is an exploded perspective of the cabinet body.

Throughout this disclosure the terms forward, backward, front, back, rear, etc., assume a frame of reference in which the door is the front side of refrigerated cabinet and there is a back wall opposite the door. This disclosure frequently uses terms like inner, outer, inward, outward, inboard, and outboard to describe the relative positions and orientations of components shown in cross section. The frame of reference for understanding such terms is in relation to the interior and exterior of the cabinet and doorframe. Cross-sectional features closer to the interior of the cabinet or doorframe are referred to as inner components as compared with cross-sectional features closer to the exterior of the cabinet or door frame, which are referred to as outer components.

Referring to FIGS. 1-7, an exemplary embodiment of a refrigerated cabinet is generally indicated at reference number 10. The refrigerated cabinet 10 comprises a cabinet body 12, a door 14, and a refrigeration system for cooling the refrigerated cabinet, shown schematically at reference number 16. In certain embodiments, the refrigeration system 16 is configured to maintain sub-freezing set point temperatures inside the cabinet body 12, such as set point temperatures of −10° F. (−23° C.) or less or set point temperatures of 20° F. (−29° C.) or less. As explained more fully below, the refrigerated cabinet 10 is specially constructed to mitigate against condensation on exterior surfaces of the cabinet body 12, even in challenging ambient conditions with relatively high dew point temperatures.

Various refrigeration systems can be used in refrigerated cabinets in the scope of this disclosure. In one or more embodiments the refrigeration system 16 comprises a complete compression-driven refrigeration circuit including an evaporator unit, a compressor, a condenser unit, a drier, an expansion device, and interconnecting tubing. Those skilled in the art will be familiar with the basic components, functions, and operations of these components in a compression-driven refrigeration circuit. In the illustrated embodiment, the refrigerated cabinet 10 is configured to receive the condenser unit and compressor in a lower mechanical compartment 18 of the cabinet body 12. The cabinet body 12 comprises a refrigerated interior 20 above the mechanical compartment 18. The evaporator unit of the refrigeration system is optionally located in an upper section of the interior 20 above the door for cooling the interior of the cabinet. It will be understood that compression-driven refrigeration systems can have other arrangements (e.g., top-mounted condenser units, evaporator units in the lower section or back section of the cabinet, etc.) without departing from the scope of the disclosure.

In the illustrated embodiment, the refrigerated cabinet 10 is a single-door cabinet, but it will be understood that other door configurations are also possible without departing from the scope of the disclosure. The cabinet body 12 has a door frame 30 defining a doorway 31 for providing access to the interior 20. The door 14 is connected to the cabinet body 12 for movement in relation to the cabinet body between an opened position (not shown) in which the door is clear of the doorway 31 for providing access to the interior 20 through the doorway and a closed position (FIG. 1) in which the door is supported against the door frame 30 and covers the doorway. The illustrated door 14 is a hinged door 14 configured to couple to the cabinet at hinges 33 for rotating about the hinges between the closed position and the open position. The illustrated door 14 comprises a recessed handle 35 opposite the hinges 33.

Figure 5:
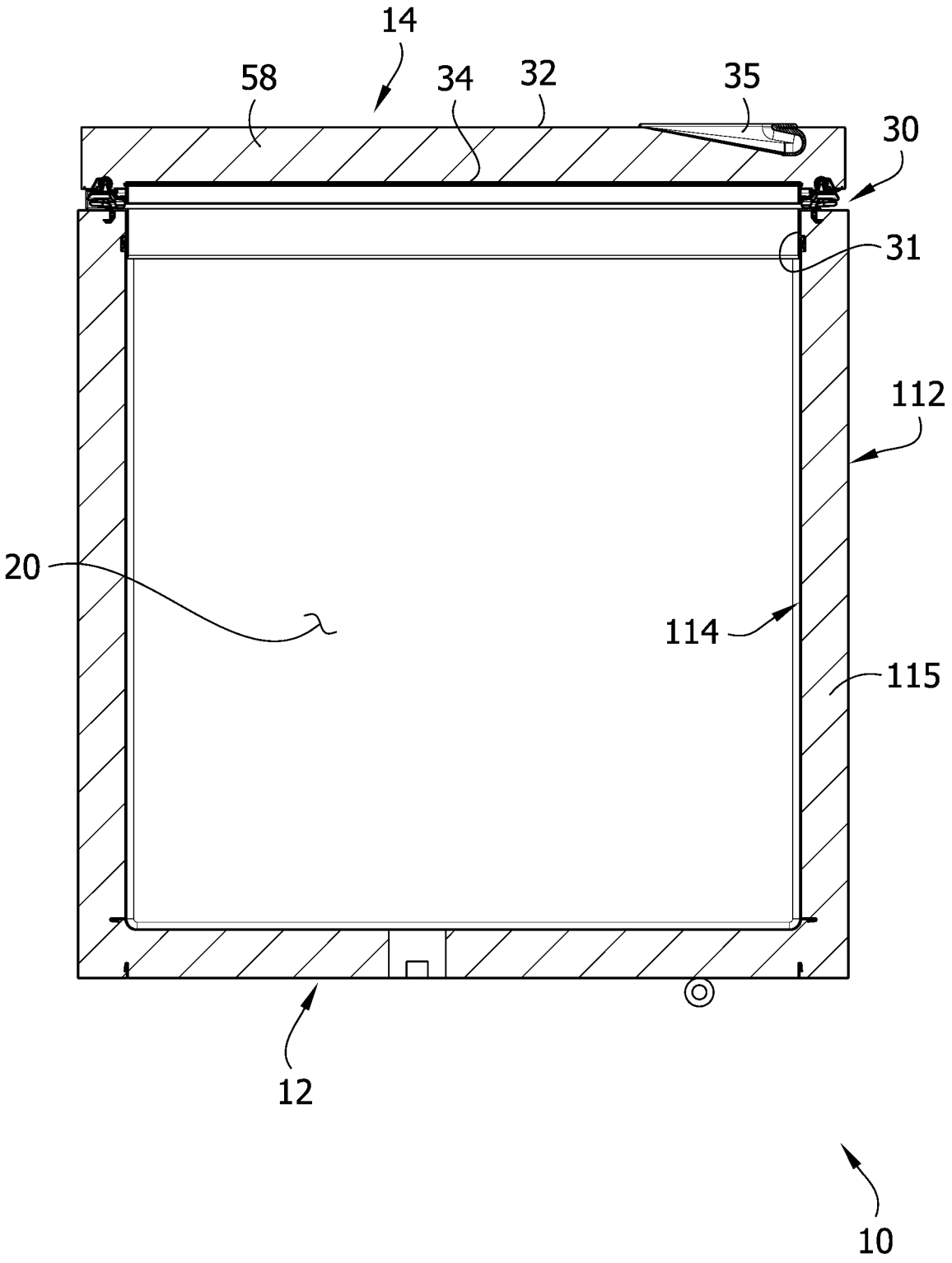
FIG. 5 is a cross section taken in the plane of line 5-5 of FIG. 2.
Figure 6:
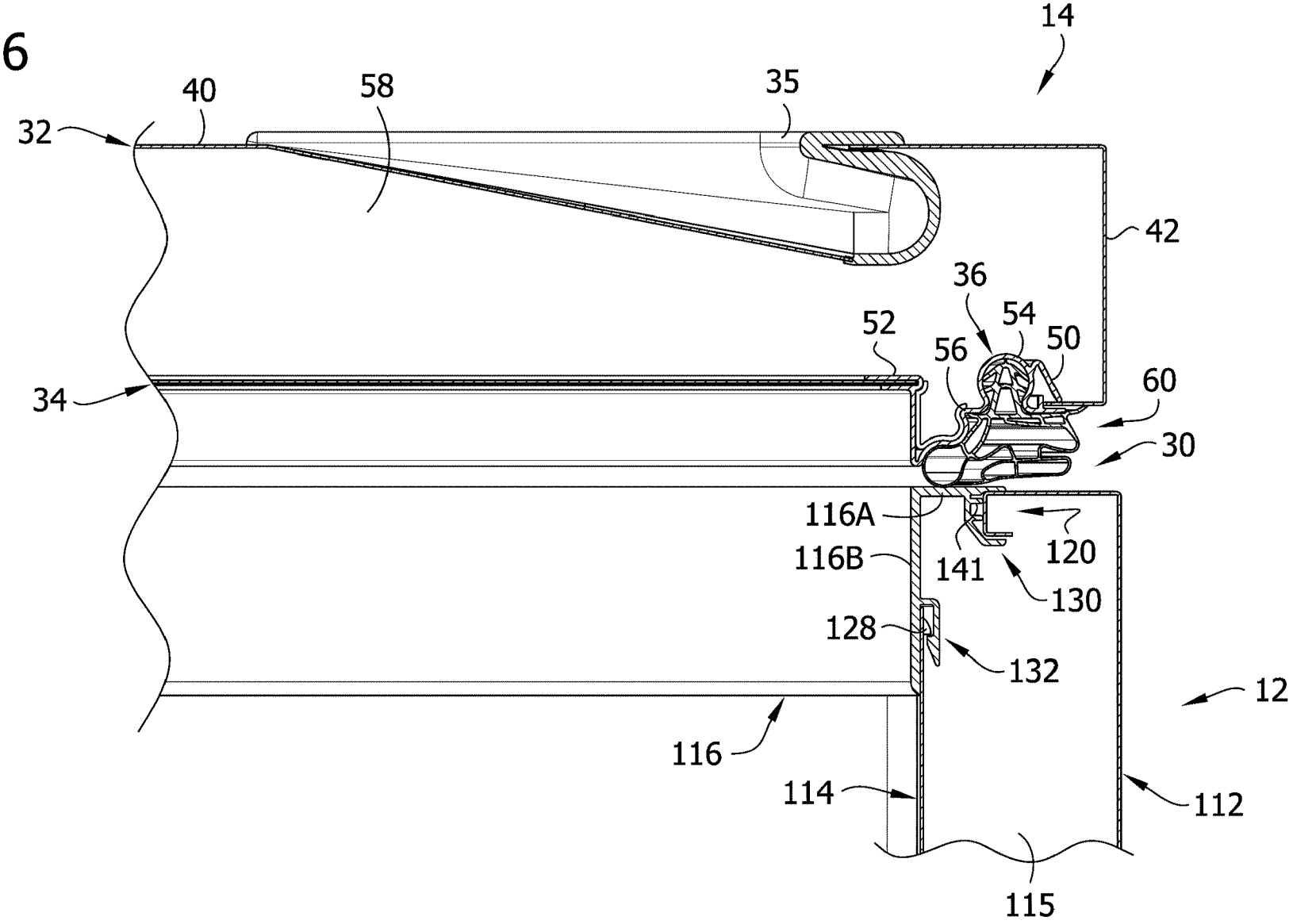
FIG. 6 is an enlarged fragmentary view of a portion of FIG. 5.
Figure 7:
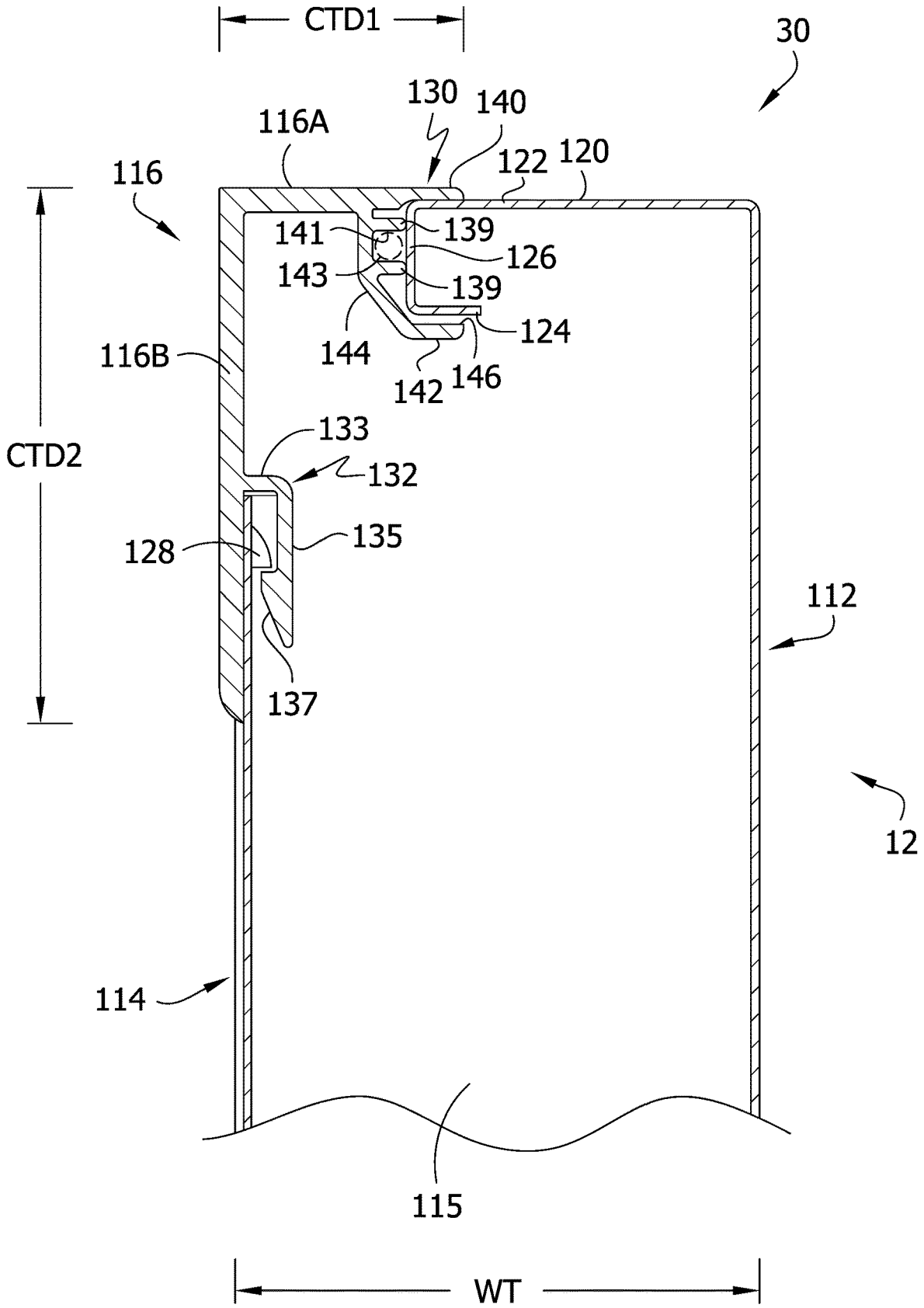
FIG. 7 is a further enlarged fragmentary cross section of a portion of a door frame of the cabinet body.

Referring to FIGS. 5-7, this disclosure now turns to details about the construction of the door 14 and the door frame 30. FIGS. 5-7 show a cross section of the refrigerated cabinet 10 in the plane of line 5-5 of FIG. 2. With the exception of the door handle 35, the major features of the perimeter portion of the door 14 and door frame 31 shown in cross-section in FIGS. 5-7 are essentially the same around the entire perimeter of the door and door frame.

The illustrated door 14 is formed from a door wrapper 32, a door liner 34, and a thermal breaker 36 that couples the door wrapper to the door liner and provides a thermal break between the door wrapper and the door liner. The door liner 36 is exposed to the interior 20 of the cabinet 10 when the door 14 is closed, and the door wrapper 32 is exposed to the exterior of the cabinet when the door is closed. The door wrapper 32 comprises a front panel 40 and double return sides 42 extending around the perimeter of the door. The rear sections of the double return sides 42 include an inner perimeter edge margin at which the wrapper 32 is configured to couple to the thermal breaker 36. The illustrated door liner 34 is substantially planar and includes an outer perimeter edge margin at which the liner is configured to couple to the thermal breaker 36.

The thermal breaker 36 comprises an outer interface 50 configured to couple to the perimeter edge margin of the wrapper 32. More particularly, the outer interface 50 comprises an outwardly opening channel that is configured to receive the inner perimeter edge margin of the wrapper 32. Similarly, the thermal breaker 36 comprises an inner interface 52 configured to couple to the perimeter edge margin of the liner 34, specifically an inwardly opening channel configured to receive the perimeter edge margin of the liner. The door thermal breaker 32 further comprises a gasket mounting feature 54 for mounting a door gasket 60 on the door. In the illustrated embodiment, the gasket mounting feature 54 comprises a channel that opens rearward for receiving a mounting dart 63 of the door gasket. The door thermal breaker 36 further comprises an inner profiled section 56 defining an outwardly facing surface that generally matches opposing surfaces of the inner portion of the door gasket 60 so that the profiled section is configured to provide conforming support for the inner portion of the door gasket.

The door wrapper 32, the door liner 34, and the thermal breaker 36 enclose an insulated interior 58 of the door 14. In the illustrated embodiment, the interior 58 is filled with foam insulation.

Figure 10:
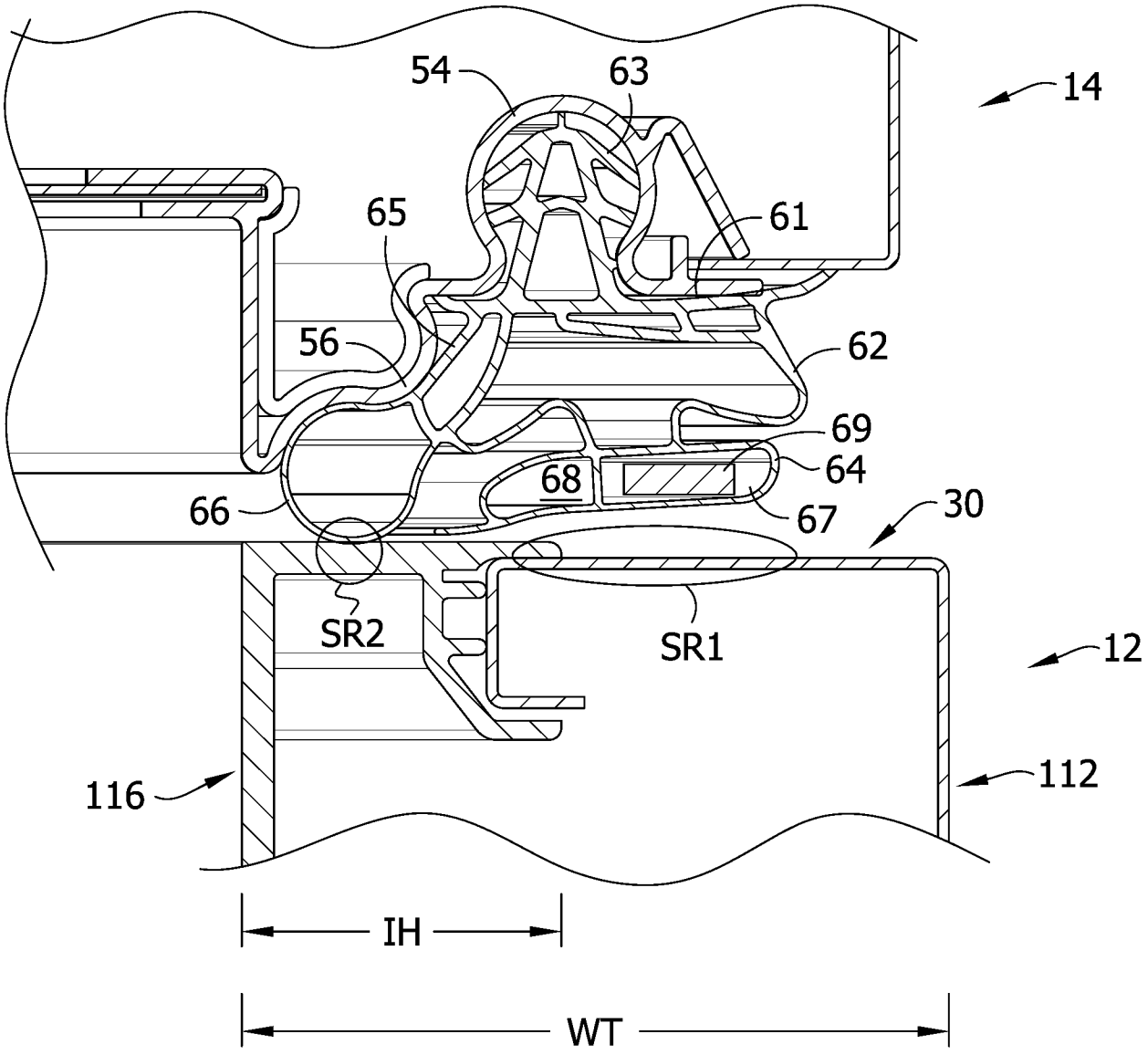
FIG. 10 is a further enlarged fragmentary view of a portion of FIG. 6.
Figure 11A:
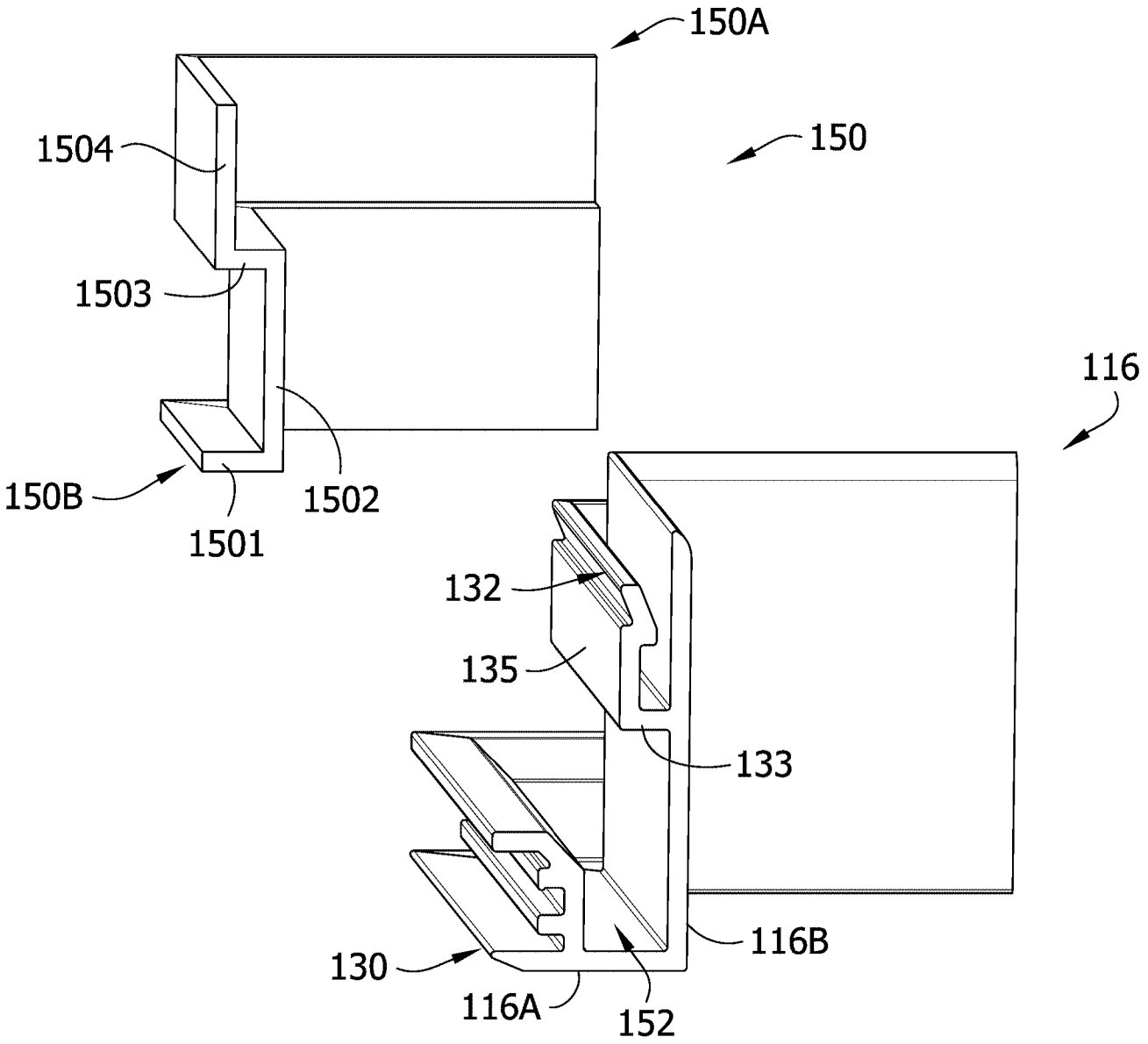
FIG. 11A is an exploded fragmentary perspective of a corner joint of a thermal breaker of the refrigerated cabinet.
Figure 11B:
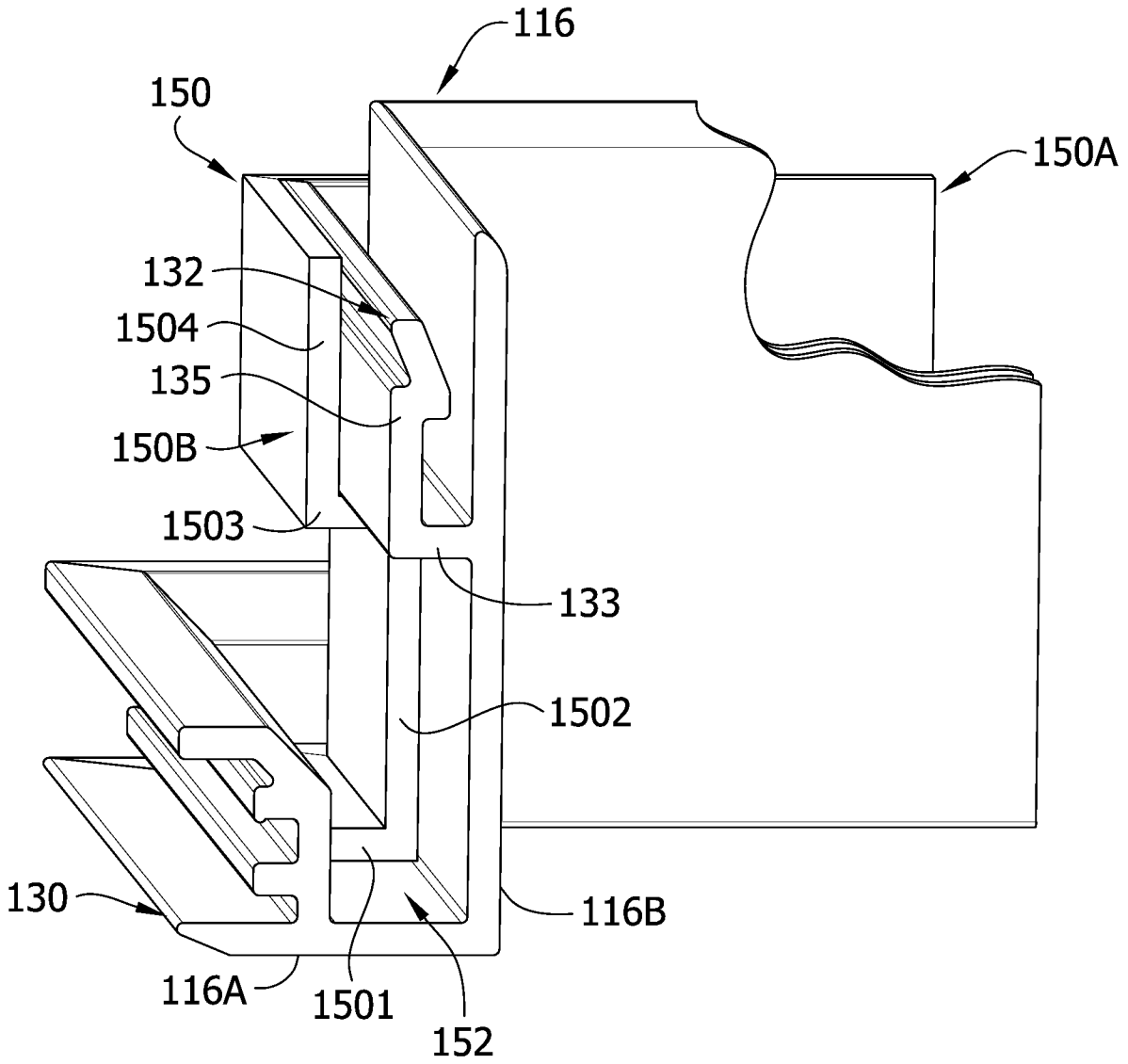
FIG. 11B is a fragmentary perspective of the corner joint.
Figure 11C:
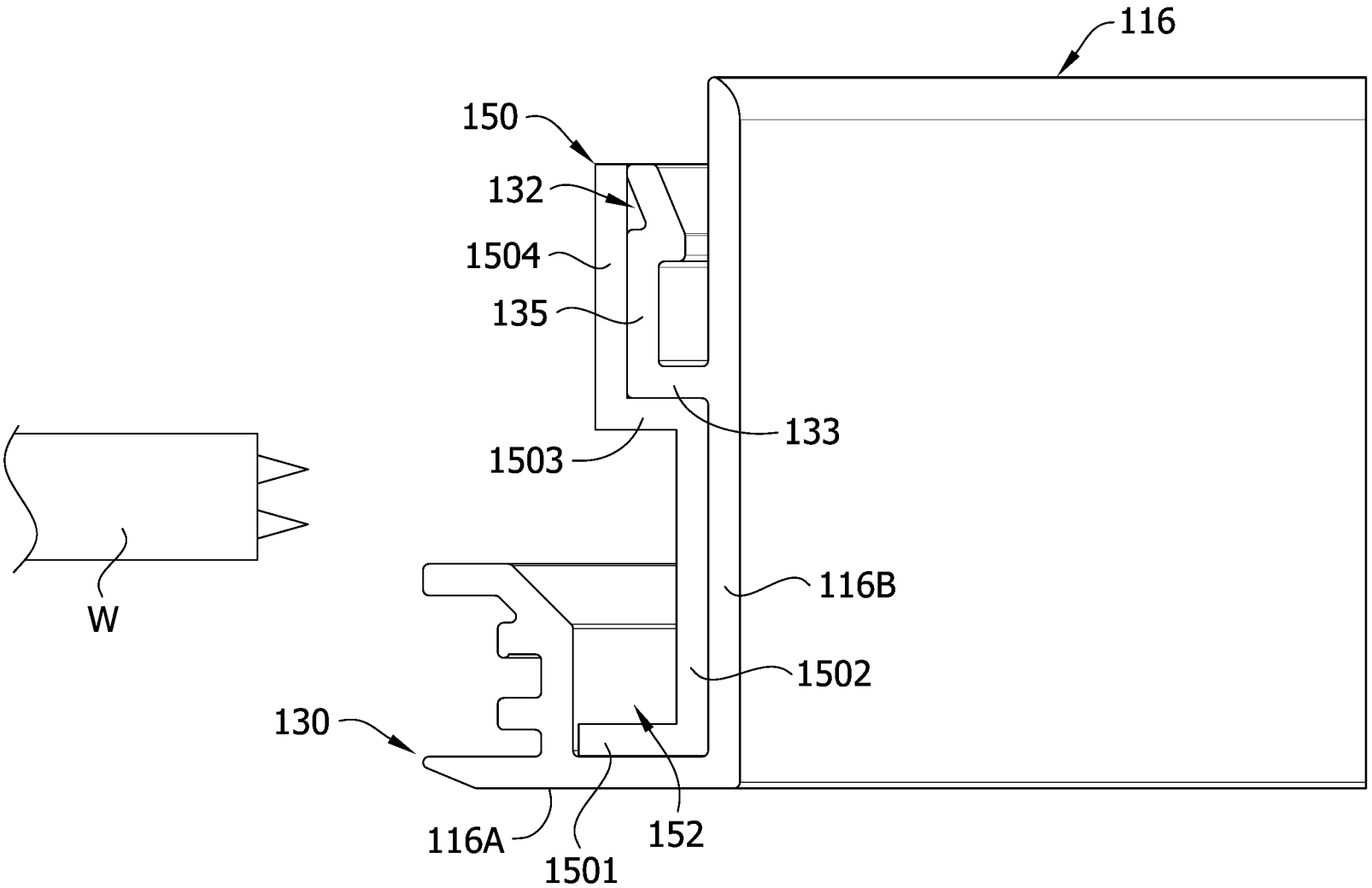
FIG. 11C is an elevation showing an ultrasonic welding tool approaching the corner joint.
Figure 11D:
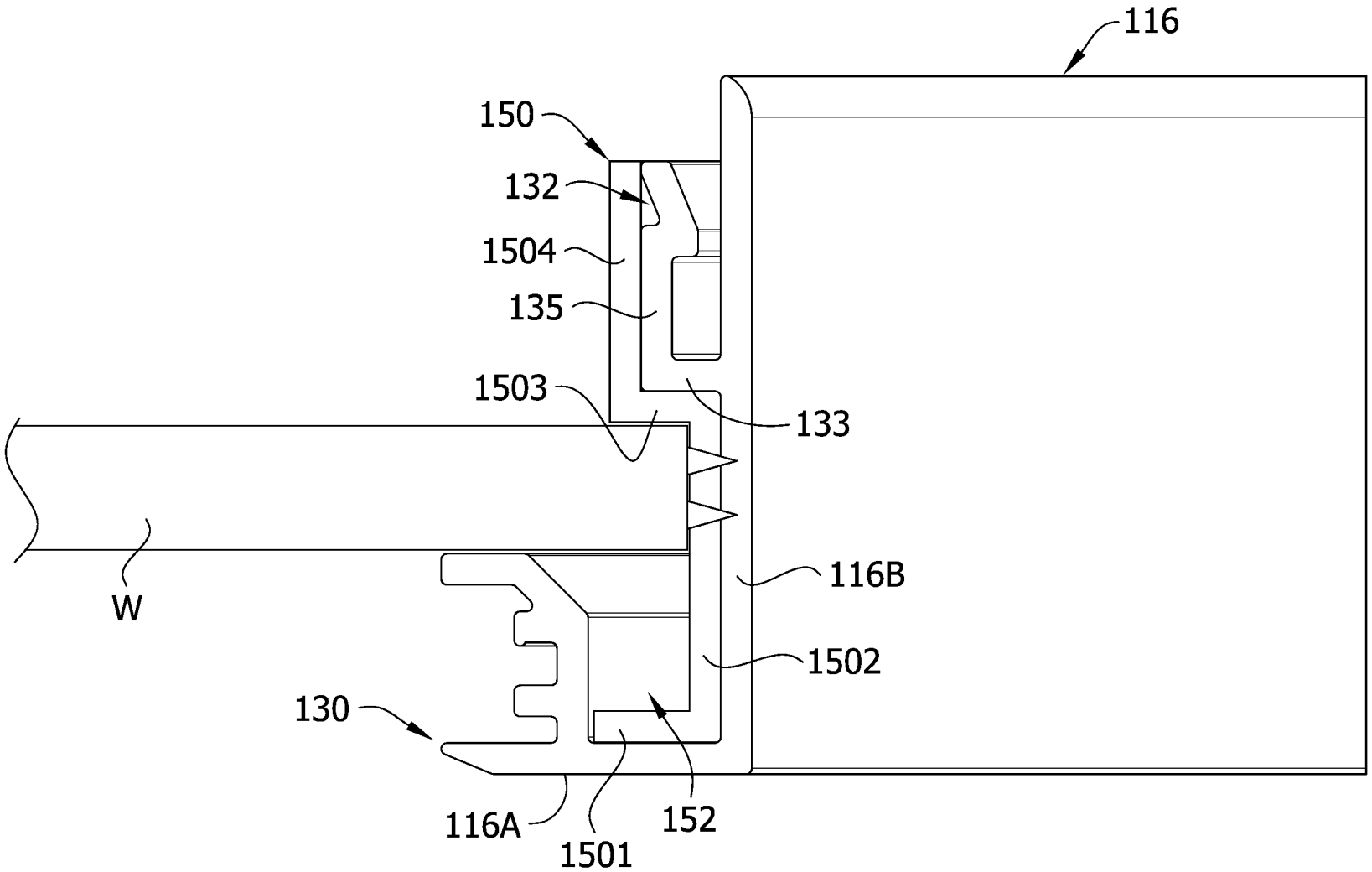
FIG. 11D is an elevation showing the ultrasonic welding tool welding the corner joint.
Figure 12:
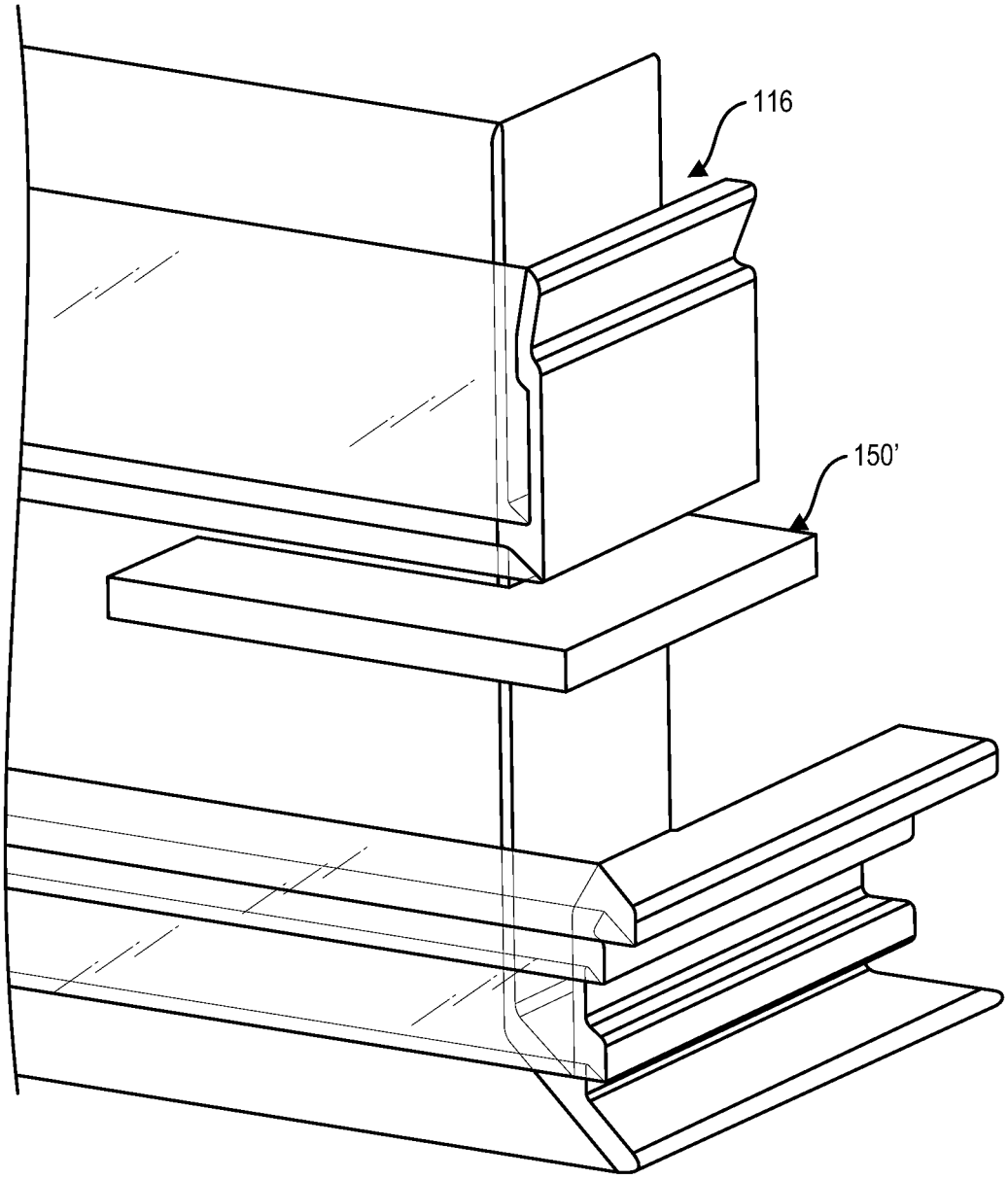
FIG. 12 is a fragmentary perspective of a corner joint of a thermal breaker of the refrigerated cabinet in which one thermal breaker piece is shown transparent and a corner joiner element is at an uninstalled position.
Figure 13:
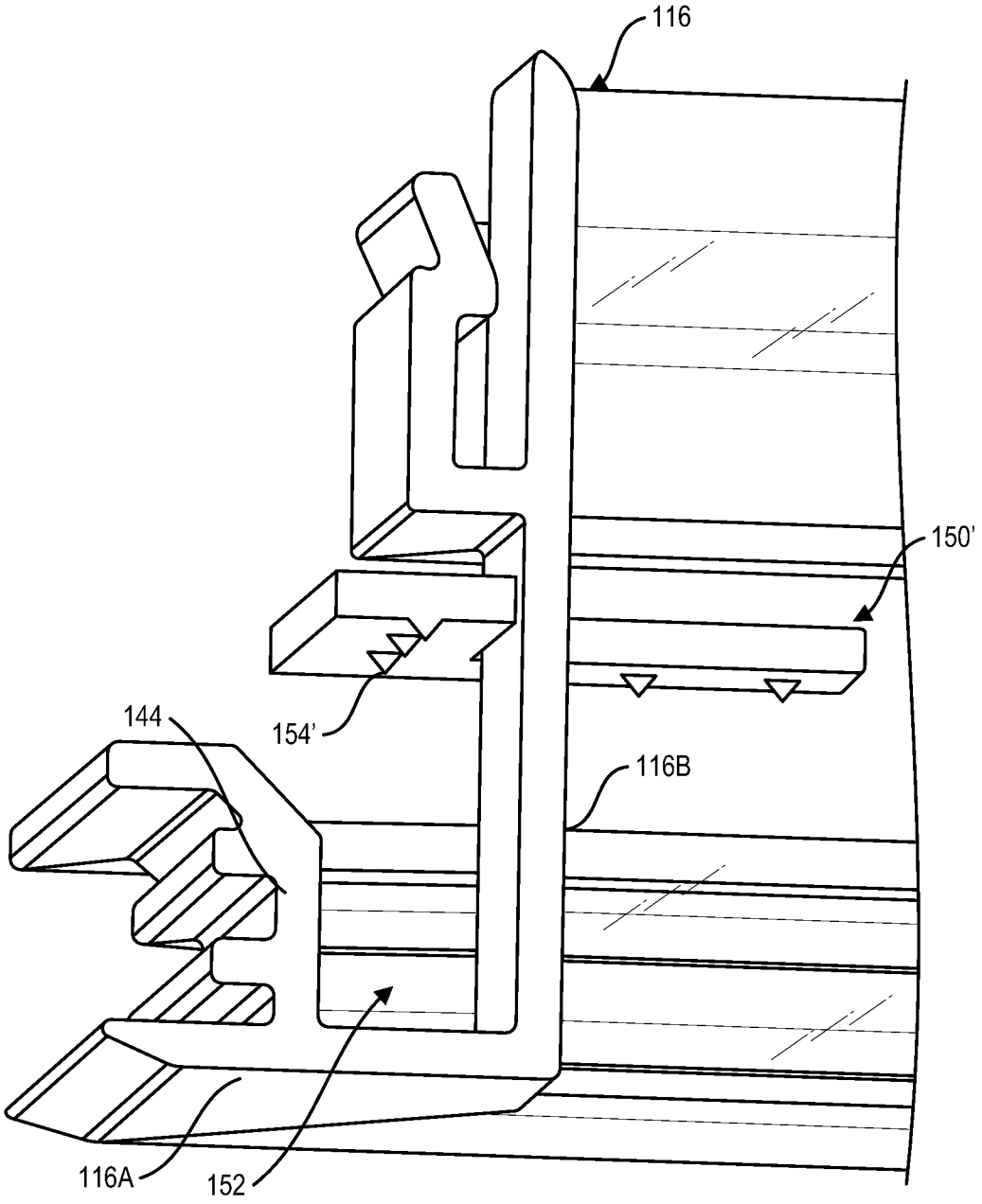
FIG. 13 is a cross sectional perspective of the corner joint showing the corner joiner element at the uninstalled position.
Figure 14:
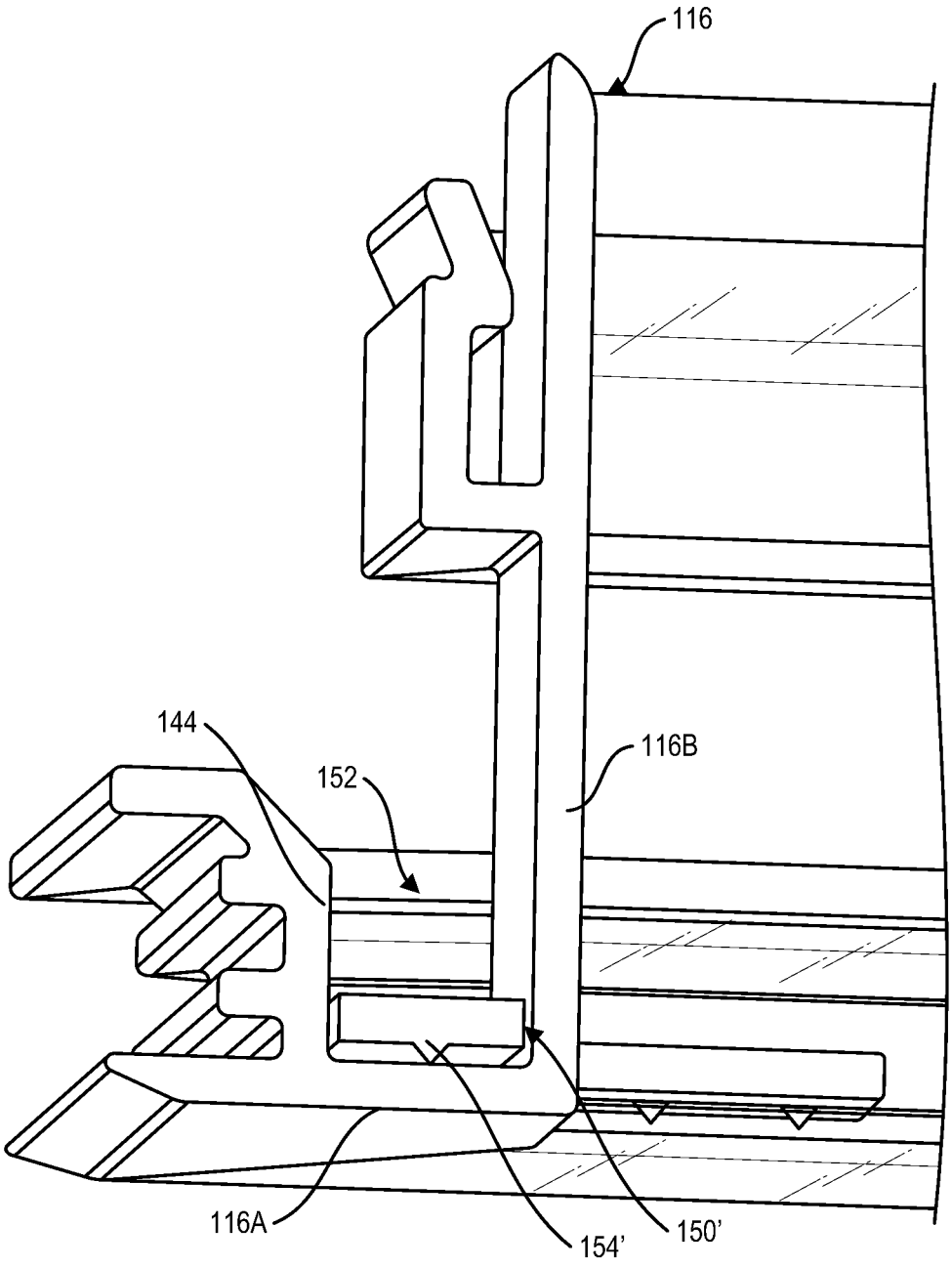
FIG. 14 is a cross sectional perspective similar to FIG. 13 but showing the corner joiner element at an engaged position for ultrasonic welding.
Figure 15:
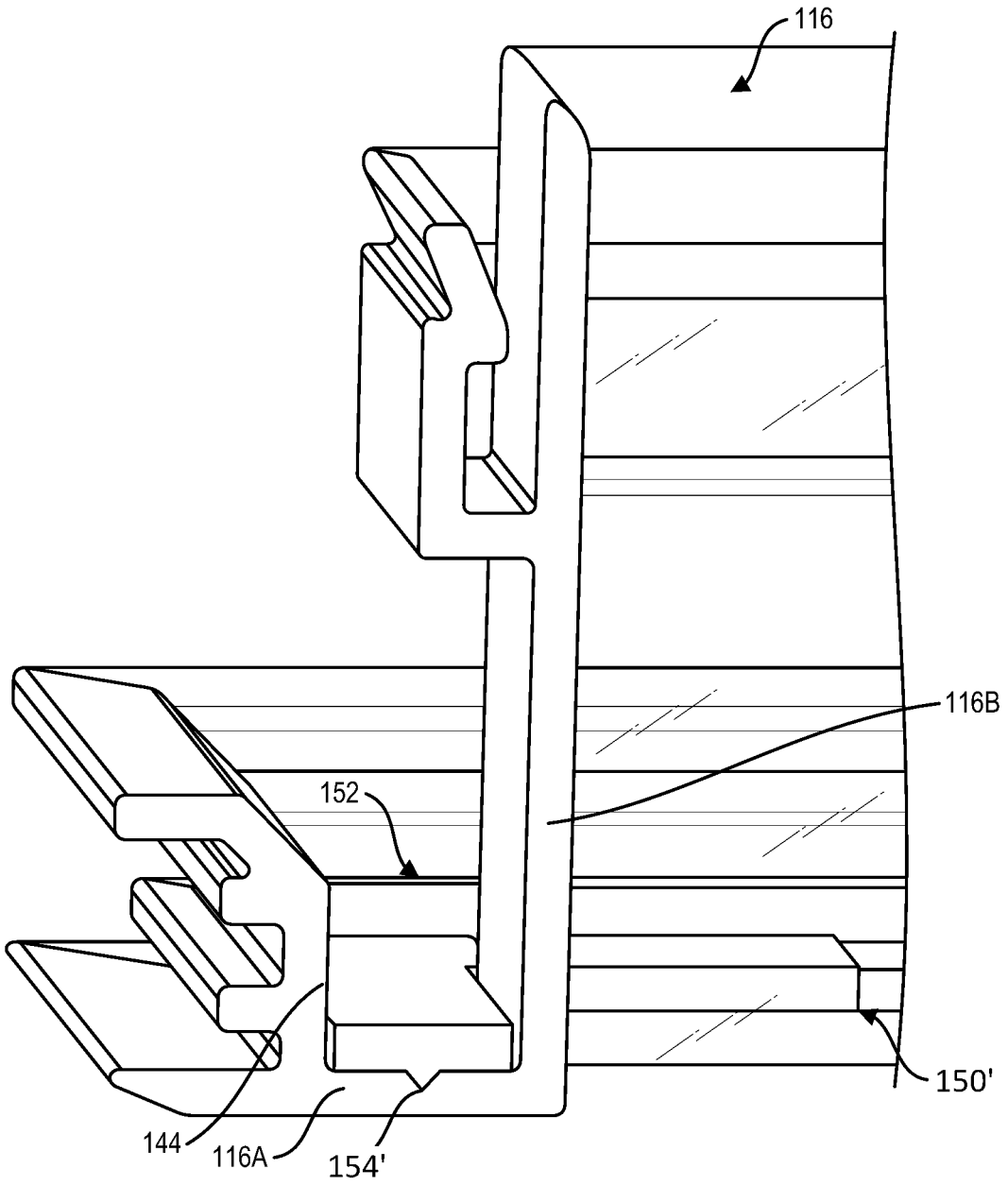
FIG. 15 is a cross sectional perspective similar to FIG. 13 showing the corner joint after the corner joiner element is welded to the thermal breaker.

Referring to FIG. 10, in the illustrated embodiment, the gasket 60 is a refrigeration gasket available from Ilpea Industries. In cross-section, the gasket comprises a relatively rigid base 61, a mounting dart 63 extending forward from the base and snap fit into the mounting channel 54, a flexible bellows 62 extending backward from the base, an outer sealing element 64 on the back end of the bellows, a relatively rigid base extension 65 extending backward from the inner end of the base inboard of the bellows and contacting the inner profiled section 56 of the door 14, and an inner sealing element 66 on the rear end of the base extension 65. The outer sealing element 64 is configured to make a magnetic seal with the door frame 30 at an outer seal region SR1. The outer sealing element 64 comprises a magnet chamber 67 and an empty chamber extending inward from the magnet chamber. A magnet 69 is received in the magnet chamber 67. When the door 14 is closed, the magnet 69 is configured to magnetically adhere the outer sealing element 64 against the forward facing surface of the door frame 30. (FIG. 10 and other cross-sectional drawings show the position of the gasket 60 immediately before the magnet 69 draws the gasket into sealing contact with the door frame 30.) The inner sealing element 66 is configured to make a second seal with the door frame 30 at an inner seal region SR2 that is spaced apart inwardly of the outer seal region SR1. The inner sealing element 66 does not rely on magnetic attraction for close contact with the door frame. Rather, the inner profiled section 56 of the door 14 is shaped and arranged to hold and support the inner sealing element 66 so that it is compressed against the forward facing surface of the door frame 30 when the door 14 is closed.

Referring to FIGS. 5-10, the cabinet body 12 comprises an outer wrapper 112 and an inner liner 114. In one or more embodiments, both the outer wrapper 112 and the inner liner 114 are formed from sheet metal, such as stainless steel sheet metal. The inner liner 114 defines the bottom, top, left side, right side, and back of the refrigerated interior 20. The outer wrapper 112 is configured to be disposed around the outside of the inner liner 114 so that an insulation space 115 is defined between the liner and the wrapper about refrigerated interior. The insulation space 115 is suitably filled with foam insulation (e.g., sprayed-in polyurethane foam insulation). Various ways of forming sheet metal liners and wrappers are known to those skilled in the art, and any suitable way can be used without departing from the scope of the disclosure. The wrapper 112 and the liner 114 are arranged so that the cabinet has a wall thickness WT extending inward from a major panel of the wrapper to an opposing major panel of the liner. In one or more embodiments the wall thickness WT is in an inclusive range of from 1.125 inches (2.9 cm) to 3.375 inches (8.6 cm)(e.g., an inclusive range of from 1.125 inches (2.9 cm) to 3.125 inches (7.9 cm), or an inclusive range of from 1.5 inches (3.8 cm) to 2.5 inches (6.4 cm)) In certain exemplary embodiments in the scope of the invention, the wall thickness WT is less than or equal to 3.0 inches (7.6 cm) (e.g., less than or equal to 2.5 inches (6.4 cm), less than or equal to 2.0 inches (5.1 cm), less than or equal to 1.8 inches (4.6 cm), or less than or equal to 1.75 inches (4.4 cm)).

The wrapper 112 and the liner 114 each have a respective front edge margin adjacent the doorway 31. The front edge margin of each of the wrapper 112 and the liner 114 extends 360° about the perimeter of the doorway 31. The front edge margins of the wrapper 112 and the liner 114 are spaced apart from one another. A plastic thermal breaker 116 is placed between the front edge margin of the wrapper 112 and the front edge margin of the liner 114 to connect the liner to the wrapper and provide a thermal break between the liner and the wrapper.

In the illustrated embodiment, the front edge margin of the wrapper 112 comprises a double return flange 120 comprising a front section 122, an opposite back section 124, and an inner section 126 extending from the front section to the back section. The front section 122 extends inward from the front corner of the door frame 30 to an inner/front corner of the double return flange 120 where the front section meets the inner section 126. The outer portion of the front section 122 is exposed on the front of the door frame 30 and thus defines a forward-facing surface of the door frame. The inner portion of the front section 122 is covered by the thermal breaker 116, as described in further detail below. Both the front section 122 and the back section 124 extend outward from respective corners where they meet the inner section 126. The back section 126 defines the terminal edge of the double return flange 120.

Figure 8:
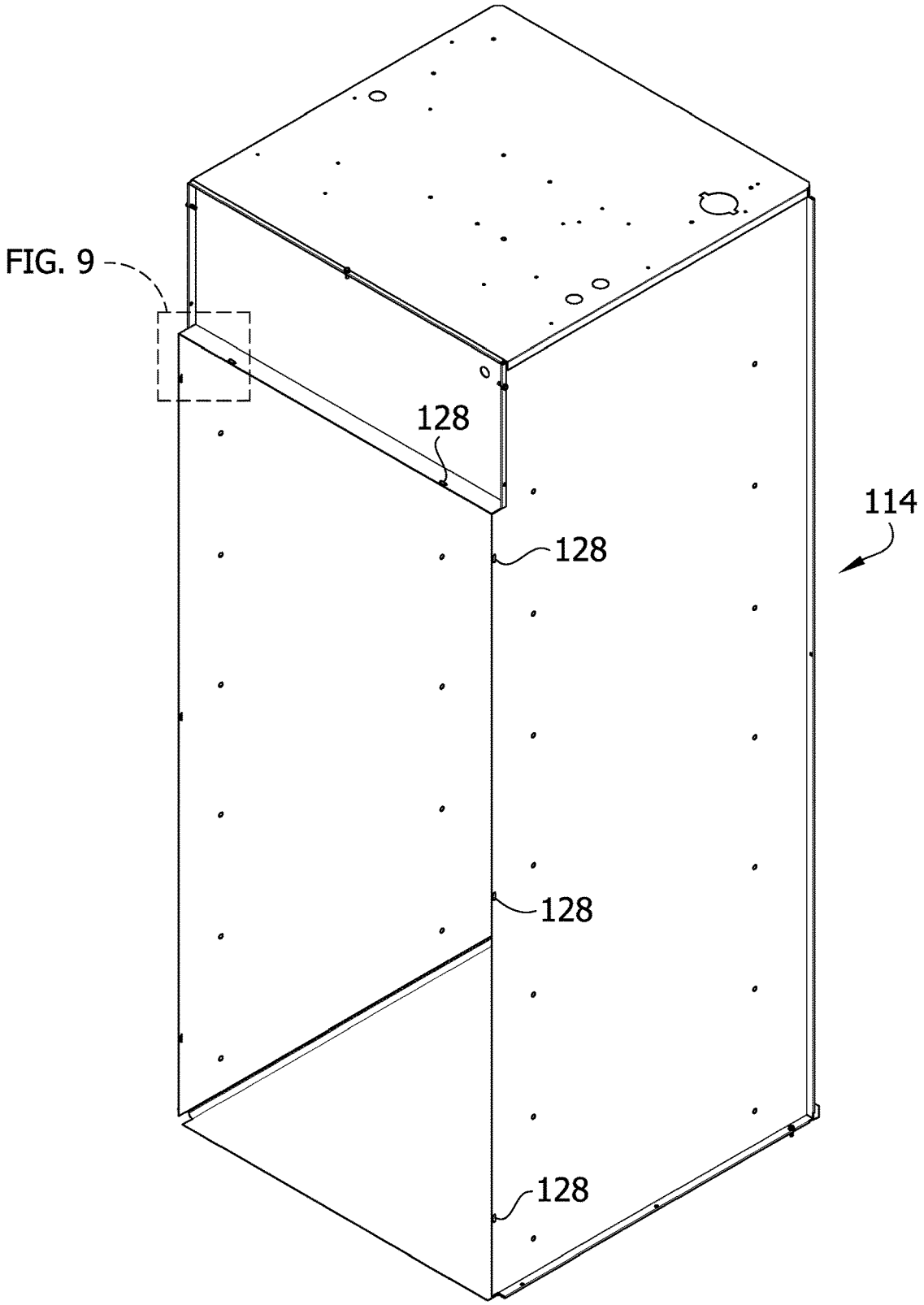
FIG. 8 is a perspective of a liner of the cabinet body.
Figure 9:
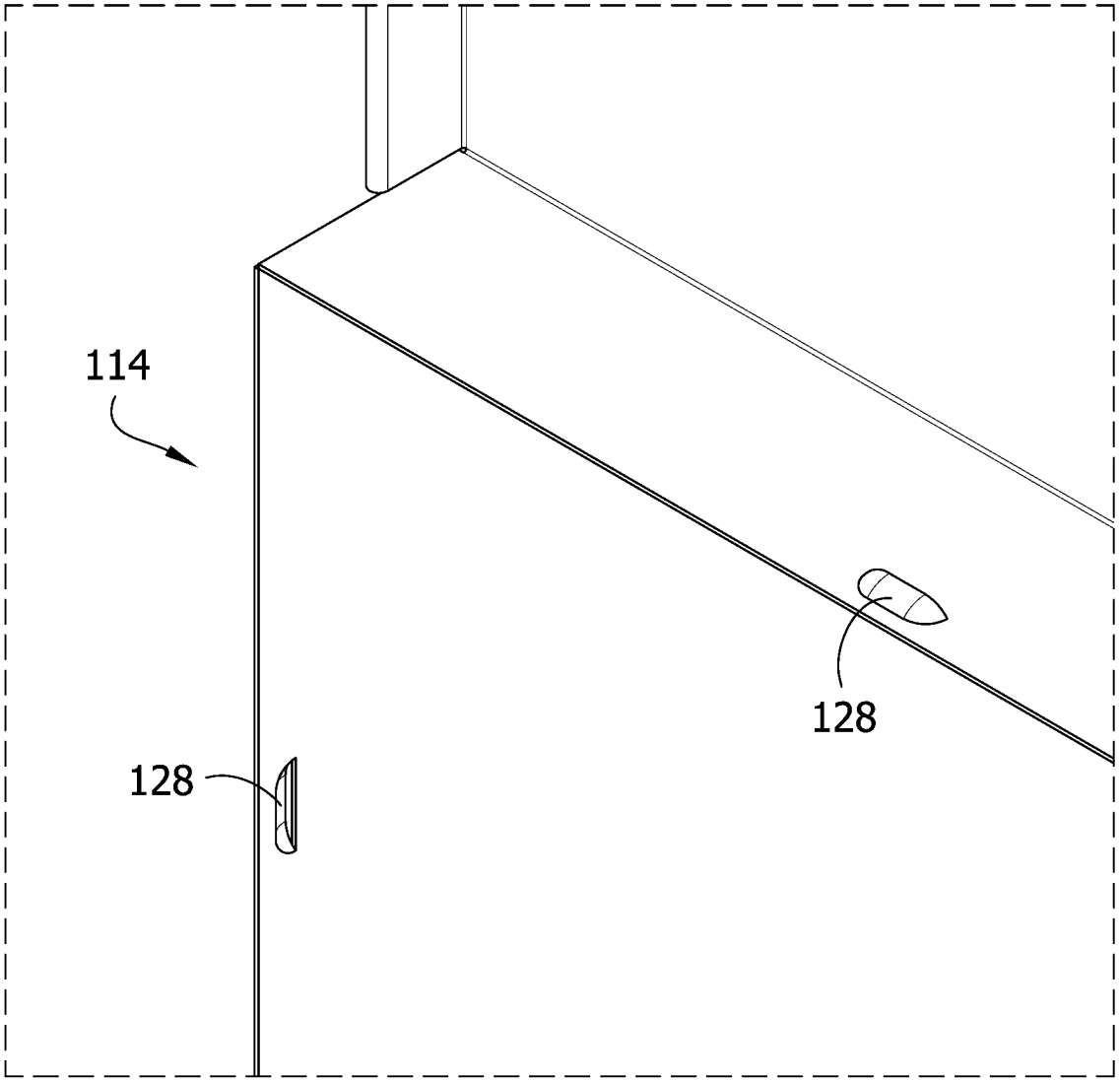
FIG. 9 is an enlarged view of a portion of FIG. 8.

Referring to FIGS. 8-9, the front edge margin of the liner 114 comprises a plurality of protrusions 128 spaced apart around the perimeter. Suitably, the front edge margin of the liner 114 comprises a plurality of protrusions 128 along each of at least the top, left and right sides of the front edge margin. In the illustrated embodiment, each protrusion 128 is formed by making a cut in the sheet metal parallel to the front edge and bending a section of the sheet metal immediately in front of the cut outward to form the protrusion. This defines protrusions 128 with tapered front end portions and back edges perpendicular to the major plane of the sheet metal.

In the illustrated embodiment, the thermal breaker 116 is a four-piece frame assembly. That is, the thermal breaker 116 comprises a top piece, a bottom piece, a left piece, and a right piece, joined together at four corners. Suitably, each of the four pieces is cut from the same type of plastic extrusion. Each of the four pieces of the thermal breaker 116 has the same cross-sectional shape. In one or more embodiments, the four thermal breaker pieces come together at miter joints. But it will be understood that other types of corner joinery can also be used without departing from the scope of the disclosure.

The thermal breaker 116 has a generally L-shaped cross-sectional shape including a front/outer section 116A that defines a forward facing door frame surface and a rear/inner section 116B generally perpendicular to the front/outer section. The rear/inner section 116B defines the doorway 31 of the refrigerated cabinet 10. The front/outer section 116A and the rear/inner section 116B meet at a corner and extend outward in perpendicular directions to respective tips. The front/outer section 116A has a first corner-to-tip dimension CTD1 that extends substantially parallel to the cabinet body wall thickness WT, and the rear/inner section has a second corner-to-tip dimension CTD2 that extends perpendicular to the first corner-to-tip dimensions CTD1 in a front-to-back direction of the refrigerated cabinet 10. In the illustrated embodiment, the second corner-to-tip dimension CTD2 is greater than the first corner-to-tip dimension CTD1. In an exemplary embodiment, the second corner-to-tip dimension CTD2 is at least 1.5-times the first corner-to-tip dimension CTD1 (e.g., the second corner-to-tip dimension CTD2 is at least twice the first corner-to-tip dimension CTD1).

The front/outer section 116A defines an outer interface 130 connected to the double return flange 120 of the wrapper 112, and the rear/inner section defines an inner interface 132 connected to the front edge margin of the liner 114. The inner interface 132 comprises a channel configured to receive the front edge margin of the liner 114 and to engage the plurality of protrusions 128 by snap fit. The channel 132 comprises an L-shaped (in cross section) extension that includes a short proximal segment 133 extending outward from the main part of the rear/inner section 116B and a longer distal segment 135 that extends rearward from the proximal segment, opposite the rear end of the main part of the rear/inner section. The distal segment 135 comprises an inwardly protruding latch hook 137. To couple the liner 114 to the thermal breaker 116, the front edge margin of the liner is inserted forwardly into the open rear end of the channel 132. The tapered front end portions of the protrusions 128 engage the leading inner ramp surface of the latch hook 137 as a wedge and thereby bend the distal segment 135 of the channel 132 outward. Upon further insertion, the protrusions 128 will clear the latch hook 137. The latch hook 137 snaps over the back edges of the protrusions to secure the front edge margin of the liner 114 in the channel 132.

The outer interface 130 comprises a channel configured to receive the double return flange 120. The outer channel 130 has a wider opening than the inner channel 132. The channel 130 has a front section 140, a back section 142, an inner section 144 extending from the front section to the back section, and an open outer end 146 opposite the inner section extending between the front section and the back section. The open outer end 146 is shaped and arranged so that the double return flange 120 of the wrapper 112 can be inserted inward into the channel 130 through the open outer end 146. The double return flange 120 can be temporarily secured in the channel 130 by tape during foaming of the insulation cavity 115. After the cavity 115 is foamed, the cured foam securely locks the double return flange 120 in the channel 130.

In the illustrated embodiment, the inner section 144 includes a front segment extending perpendicularly rearward from the main part of the front/outer section 116A, and a rear segment that extends rearward and outward at an angle from the front segment to the back section 142. The outer channel 130 further comprises first and second interior legs 139 (FIG. 7) extending outward perpendicularly from the front segment of the inner section 144 to define a heating element duct 141. The outer ends of the legs 139 of the heating element duct 141 are configured to engage the inner section 126 of the double return flange 120 to support the double return flange in the outer channel 130. In addition, the legs 139 are arranged so that the heating element duct 141 is configured to receive an optional frame heater 143 (e.g., a resistance heating wire or hot gas loop tubing). The channel 130 is configured to hold the frame heater 143 in thermal communication with the front edge margin of the wrapper, e.g., by pressing the heater against the inner section 126 of the double return flange 120. The door frame 30 is free of metal material in front of the heating element duct 141. Only plastic material is in front of the heating element duct 141.

Referring to FIGS. 11A-11D, in certain embodiments the thermal breaker 116 can comprise corner joiner elements 150 at each of the four corners of the door frame. The corner joiner elements 150 are generally configured for joining the four pieces of the thermal breaker 116 at the corners of the door frame 130. In the illustrated embodiment, each corner joiner element 150 comprises a key formed from thermoplastic material such as PVC or ABS (suitably, the thermal breaker pieces 116 are also formed of thermoplastic material). Each thermoplastic key 150 comprises a single piece of monolithic (e.g., molded) thermoplastic material having first and second sections 150A, 150B. The first and second key sections 150A, 150B have the same cross-sectional shape but extend at a right angle. In cross-section, each key section 150A, 150B comprises a front segment 1501 configured to extend in a plane parallel to the door frame 30, an inner segment 1502 extending backward from an inner end of the front segment, an outturned segment 1503 extending outward from the rear end of the inner segment, and a rear segment 1504 extending backward from an outer end of the outturned segment. The cross-sectional shape of each key section 150A, 150B is configured so that the front segment 1501, inner segment 1502 and outturned segment 1503 nest in the space 152 between the outer interface 130 and the inner interface 132 and the front segment and inner segment sit flush against the insulation-facing sides of the front/outer section 116A and rear/inner section 116B, respectively. The outturned segment 1503 and the rear segment 1504 are in flush contact with the proximal segment 133 and distal segment 135 of the inner interface 132, respectively.

As explained above, the individual pieces of the thermal breaker 116 meet at mitered corners. Each key 150 is received in the spaces 152 of two thermal breaker pieces defining a mitered corner so that the first section 150A of the key engages a first thermal breaker piece and the second section 150B of the key engages a second thermal breaker piece. To secure each corner of the thermal breaker 116, at each of the first and second key sections 150A, 150B, an ultrasonic welding tool W is pressed inward against the inner segment 1502 while ultrasonic energy is applied to join the key 150 to the respective thermal breaker piece. The ultrasonic energy creates sufficient heat to weld the key 150 to the respective thermal breaker piece. When such welds are formed between the key 150 and both thermal breaker pieces at the mitered corner, the key and welds firmly join the two thermal breaker pieces making a strong corner joint.

Referring to FIGS. 12-15, in certain embodiments the thermal breaker 116 can comprise alternative corner joiner elements 150' at one or more of the four corners of the door frame. The corner joiner elements 150' are generally configured for joining the four pieces of the thermal breaker 116 at the corners of the thermal breaker. In the illustrated embodiment, the corner joiner element 150' comprises a L-shaped thermoplastic plate (suitably, the thermal breaker pieces 116 are also formed of thermoplastic material). At each corner of the thermal breaker 116, one of the L-shaped plates 150' is received in the gap 152 between the channel section 144 and the rear/inner section 116B. As explained above, the individual pieces of the thermal breaker 116 meet at mitered corner. Each plate 150' is received in the gaps 152 of the two thermal breaker pieces defining the mitered corner so that a first section of the plate engages against the front/outer section 116A of a first thermal breaker piece and a second section of the plate engages the front/outer section 116A of a second thermal breaker. The illustrated corner joiner elements 116 comprise a plurality of forward-facing energy directors 154' spaced apart along the first and second sections of the plate. Each energy director 154' is small conical protrusion on the front side of the plate. To secure each corner of the thermal breaker 116, the plate is pressed forward in the gap 152 against the front/outer sections 116A. Then the manufacturer uses an ultrasonic welding system to impart ultrasonic energy. The energy is directed to the interface between the plate 150' and the front/outer sections 116A where it creates sufficient heat to weld the plate to the two thermal breaker pieces, thereby firmly joining the two thermal breaker pieces at the corner.

Referring again to FIG. 10, it can be seen that the door frame 30 of the cabinet body 12 is designed so that the inner sealing element 66 of the gasket 60 is configured to seal against the forward facing surface of the thermal breaker 116 and the outer sealing element 64 is configured to seal against the forward facing surface of the wrapper 112. The door frame 30 and the door 14 are arranged with respect to one another so that the gasket magnet 69 aligns with the exposed forward facing surface of the wrapper. In the illustrated embodiment, this is achieved by configuring the thermal breaker 116 so that the front part of the front/outer section is located entirely on the inner half IH of the wall thickness T of the cabinet body 12. Thus, the plastic material on the front face of the door frame 30 is only located on the inner half IH of the door frame thickness WT. The outer half of the front face of the door frame 30 is entirely metal, and in this case, formed by the wrapper 112.

Preferably, the wrapper 112 is formed from ferromagnetic material so that the magnet 69 of the outer sealing element 64 is magnetically attracted to the front section of the wrapper without inclusion of any other magnetic materials in the door frame 30. In certain embodiments, however, it is conceivable to use a non-magnetic metal for the wrapper and to add a magnetic or ferromagnetic strip in the door frame along the front section of the double return flange where it would align with the gasket magnet.

Accordingly, the illustrated refrigerated cabinet 10 is configured so that the door gasket 60 makes an outer seal with a metal section of the door frame 30 at the outer seal region SR1 and an inner seal with a plastic section the door frame at the inwardly spaced inner seal region SR2. The heating element duct 141 is spaced apart inward of the outer sealing region SR1 and outward of the inner sealing region SR2.

The inventors initially developed the above-described refrigerated cabinet 10 with an intent to improve manufacturability. In that regard, the inventors believe that the design has yielded substantial improvements. For example, the thermal breaker 116 is constructed from a simple and robust plastic extrusion. The door frame 30 is configured to magnetically adhere with the gasket 60 at the wrapper 112, without any other ferromagnetic materials being included. The door frame 30 is free of magnets and ferromagnetic metal strips, the inclusion of which adds substantial manufacturing complexity and cost to many prior art cabinet designs. Additionally, components of the cabinet body 12 couple together with relative ease and a high degree of safety. The double-return flange 120 of the wrapper 112 provides a smooth (non-sharp) surface for gripping during assembly, and the snap-in features 128 on the front edge margin of the liner 114 enable rapid fastening to the thermal breaker during assembly.

In addition to the substantial benefits of the above-described refrigerated cabinet 10 in terms of manufacturability, the inventors surprisingly discovered substantial improvements in performance—particularly, mitigation against condensation at the door frame 30. The refrigerated cabinet 10 has been tested and found to prevent condensation from forming at the door frame 30 when the refrigeration system 16 maintains a −10° F. (−23° C.) set point in ambient conditions of at least 90° F. (32° C.) and at least 70% relative humidity without heating the door frame. Additionally, with a heating wire in the heating duct 141 operating at 1.7 W/ft (5.6 W/m), the refrigerated cabinet 10 was found to prevent condensation from forming at the door frame 30 when the refrigeration system maintains the −20° F. (−29° C.) set point in ambient conditions of at least 90° F. (32° C.) and at least 70% relative humidity. Even with a lower performing single-seal gasket G (FIGS. 16-17) installed in place of the dual-seal gasket 60, the refrigerated cabinet 10 was found to prevent condensation from forming at the door frame 30 when the refrigeration system maintains the −10° F. (−23° C.) set point in ambient conditions of at least 90° F. (32° C.) and at least 70% relative humidity with a heating wire in the heating duct 141 operating at 1.7 W/ft (5.6 W/m) at 50% duty cycle. The inventors believe that this level of condensation mitigation performance has never been achieved in a refrigerated cabinet with a metal wrapper and foam insulation walls less than 3.0 inches (7.6 cm) thick. Indeed, the inventors have conducted a series of tests that show prior art cabinets are not able to achieve this level of thermal insulation.

Examples

The inventors have conducted testing that shows that the refrigerated cabinet 10 can substantially reduce door frame condensation in comparison with prior art refrigerated cabinets. The results of the tests are described more fully below. The procedure for each test was as follows: first, the cabinet subject to testing was placed into a climate controlled chamber maintained at a controlled temperature and humidity. Second, the refrigerated cabinet under test was run inside the climate controlled chamber for four hours at a defined set point temperature below freezing. Third, after running the refrigerated cabinet in the climate controlled chamber for the four-hour testing period, the tester waited until the compressor cycled off. Fourth, immediately after the compressor cycled off, the tester inside the climate controlled chamber opened to the door to the refrigerated cabinet and took a thermal image of the upper corner of the door frame away from the hinge using a FLUKE TIS 45 thermal imager.

Figure 16:
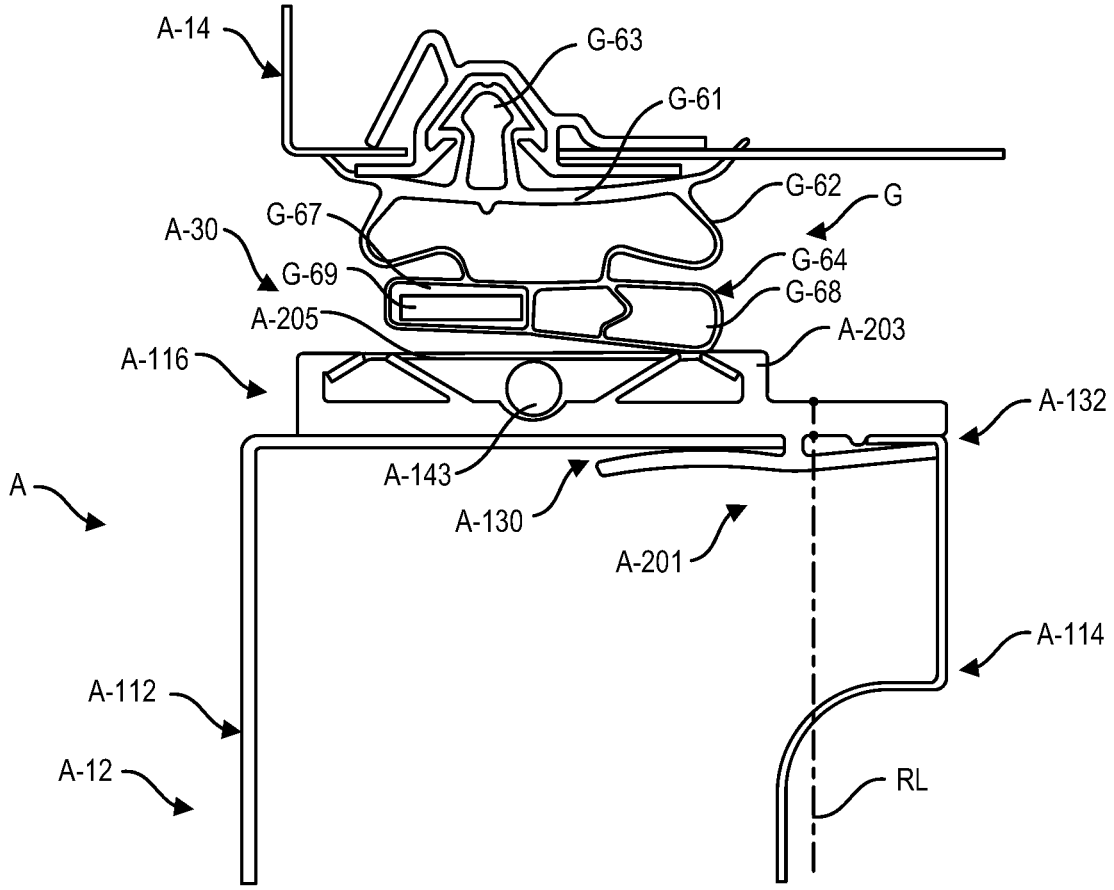
Prior Art FIG. 16
FIG. 16 is a fragmentary cross section of a door frame of a refrigerated cabinet of the prior art.

Referring to FIG. 16, one of the prior art cabinets tested is generally indicated at reference A. The cabinet A comprises a cabinet body A-12 including a metal outer wrapper A-112, a metal inner liner A-114, and a plastic thermal breaker A-116 connecting the front edge margin of the wrapper to the front edge margin of the liner along the door frame A-30. In contrast with the wrapper 112 of the present disclosure, the front edge margin of the wrapper A-112 lacks the double return flange and extends further inward along the wall thickness of the door frame A-30. In comparison with the liner 114 of the present disclosure, the liner A-114 has a different profile. Near the doorframe A-30, the liner A-114 curves inward such that the door frame A-30 is thicker than the door frame 30. Reference line RL shows where the inner surface of the door frame 30 would be located if it were overlaid on FIG. 16 so that the outer surface of the wrapper 112 aligned with the outer surface of the wrapper A-112. From the curved segment, the liner A-114 extends straight forward to a coupling flange that extends perpendicularly outward.

In comparison to the thermal breaker 116 of the present disclosure, the thermal breaker A-116 of the prior art cabinet A has a relatively flat cross-sectional shape extending predominately in the front plane of the door frame. The back side of the thermal breaker A-116 includes a two-sided clip feature A-201 that defines the outer and inner interfaces A-130, A-132 for connecting to the front edge margin of the wrapper A-112 and liner A-114, respectively. The front side of the plastic thermal breaker A-116 extends across substantially the entire wall thickness of the door frame A-30 such that no portion of the wrapper A-112 is forwardly exposed for contact with the conventional door gasket G. Hence, the front side of the thermal breaker A-116 includes a strip retainer A-203 for retaining a ferromagnetic strip A-205 at the front of the door frame. The door gasket G is configured to magnetically adhere to the strip A-205 and seal with the door frame along the strip. The thermal breaker A-116 is configured to retain a heating element A-143 behind the ferromagnetic strip.

The door gasket G comprises a base G-61, a mounting dart G-63 extending forward from the base and snap fit into the mounting channel of the door A-14, a flexible bellows G-62 extending backward from the base, and an outer sealing element G-64 on the back end of the bellows. The outer sealing element G-64 comprises a magnet chamber G-67 and a partitioned 'pillow' chamber G-68 extending inward from the magnet chamber. A magnet G-69 is received in the magnet chamber G-67. When the door A-14 is closed, the magnet G-69 is configured to magnetically adhere the outer sealing element G-64 against the forward facing surface of the door frame A-30, particularly the ferromagnetic strip A-205.

Figure 17:
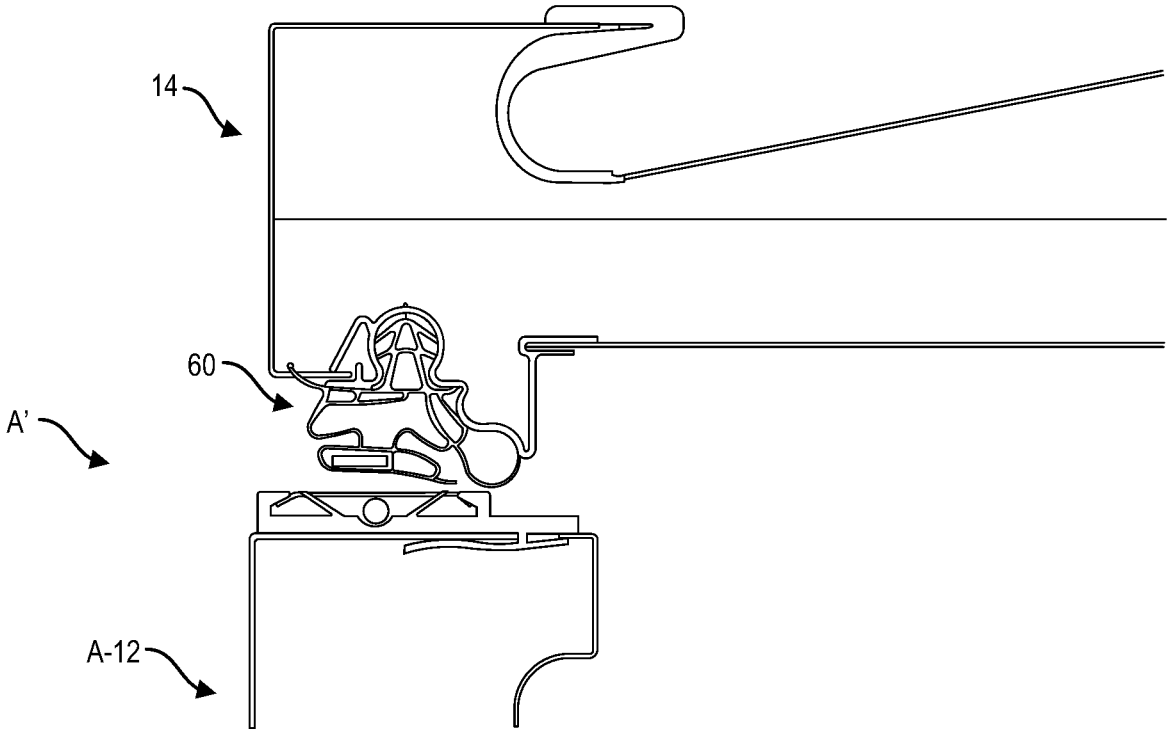
Prior Art FIG. 17
FIG. 17 is a fragmentary cross section of a door frame of another refrigerated cabinet of the prior art.

Referring to FIG. 17, another control cabinet A' used for testing includes the same cabinet body A-12 as the cabinet A but utilizes the door 14 and gasket 60 of the cabinet 10 discussed above instead of the door A-14 and gasket G.

The results of tests on various different refrigerated cabinet configurations are shown on charts, the first examples of which are found in FIGS. 18-21. Each chart plots measured temperature of the front face of the door frame in relation to distance from the outer corner of the door frame. Unless otherwise indicated, the horizontal axis has a zero value that corresponds to the outermost corner of the door frame and extends to a location 1.75 inches (4.4 cm) from the outermost corner. To better illustrate where the temperature profile is being measured, each chart is superimposed onto a cross section of door frame of the respective refrigerated cabinet where the temperature measurement was taken. Each of FIGS. 18-21 shows the results of tests conducted with the climate controlled chamber set to 90° F. (32° C.) and 70% relative humidity and the refrigerated cabinet running at an internal set point temperature of −10° F. (−23° C.). A subset of tests was conducted without running door frame heaters, another subset of tests was conducted while running door frame heaters at 50% duty cycle, and third subset of tests was conducted while running door frame heaters at 100% duty cycle. In each test where heat was applied, unless otherwise indicated, the door frame heater was an electrical heater configured to operate at 1.7 W/ft (5.6 W/m).

Figure 18:
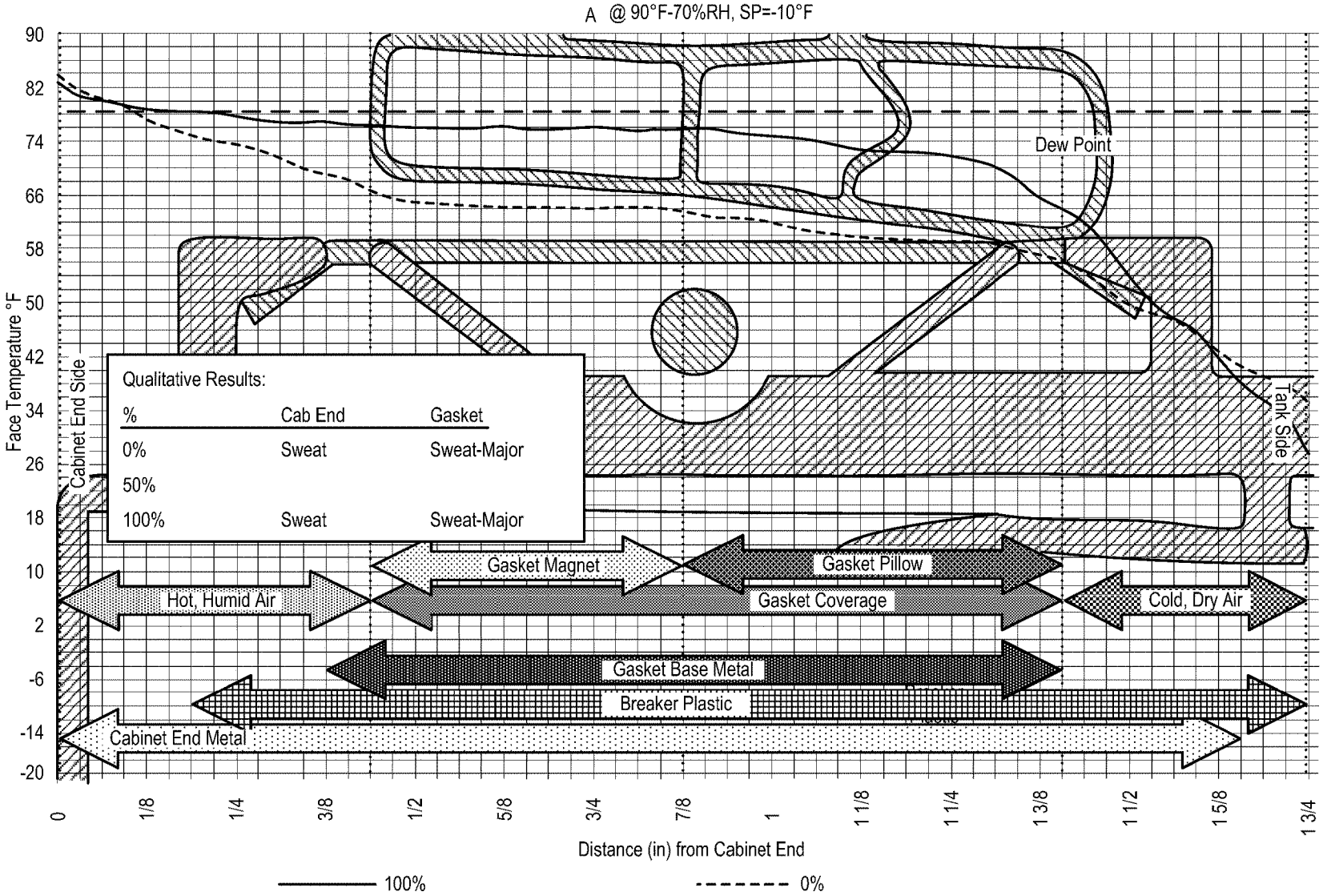
FIG. 18 is a chart superimposed on an enlarged fragmentary cross section of the door frame of the prior art refrigerated cabinet shown in FIG. 16, the chart plotting door frame face temperature across the outer 1¾" (4.4 cm) thickness of the door frame after conducting climate controlled tests at ambient temperature of 90° F. (32° C.), ambient relative humidity of 70%, and cabinet set point temperature of −10° F. (−23° C.)

FIG. 18 shows the results for two tests of the prior art cabinet A of FIG. 16. A first test was conducted without running the door frame heater A-143. The measured temperature fell below the dew point only about ⅛" (0.3 cm) from the outer corner of the door frame, which is about 5/16" (0.8 cm) outboard of the outer end of the gasket G and more than 2¼" (5.7 cm) outboard of the inner corner of the door frame A-30. As a result, significant condensation formed on both the exterior of the wrapper A-112 and the gasket G. The second test was conducted running the door frame heater at 100% duty cycle. Still, measured temperature fell below the dew point only about 7/32" (0.6 cm) from the outer corner of the door frame, which is spaced apart about 7/32" (0.6 cm) outboard of the outer end of the gasket G and more than 2" (5 cm) outboard of the inner corner of the door frame A-30. So even with the door frame heater A-143 running at 100% duty cycle, significant condensation formed on both the exterior of the wrapper A-112 and the gasket G.

Figure 19:
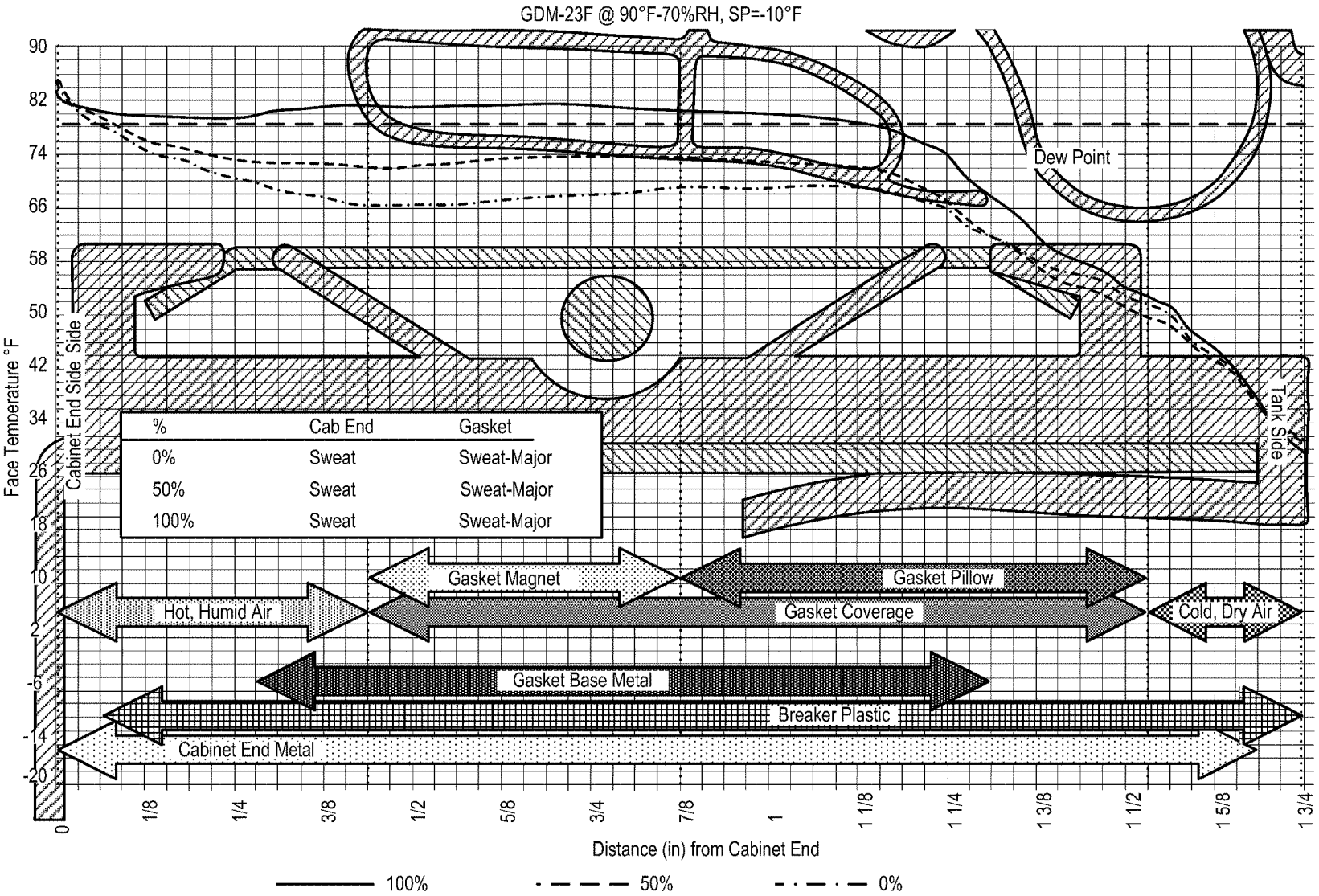
FIG. 19 is a chart superimposed on an enlarged fragmentary cross section of the door frame of the prior art refrigerated cabinet shown in FIG. 17, the chart plotting door frame face temperature across the outer 1¾" (4.4 cm) thickness of the door frame after conducting climate controlled tests at ambient temperature of 90° F. (32° C.), ambient relative humidity of 70%, and cabinet set point temperature of −10° F. (−23° C.)

FIG. 19 shows the results of three tests of the control cabinet A' of FIG. 17. A first test was conducted without running the door frame heater. The measured temperature fell below the dew point less than ⅛" (0.3 cm) from the outer corner of the door, which is about 5/16" (0.8 cm) outboard of the outer end of the gasket G and more than 2¼" (5.7 cm) outboard of the inner corner of the door frame A-30. Hence, significant condensation formed on both the exterior of the wrapper A-112 and the gasket 60. The second test was conducted running the door frame heater at 50% duty cycle. Again, the measured temperature fell below the dew point less than ⅛" (0.3 cm) from the outer corner of the door frame, which is about 5/16" (0.8 cm) outboard of the outer end of the gasket G and more than 2¼" (5.7 cm) outboard of the inner corner of the door frame A-30. Significant condensation was again observed on both the exterior of the wrapper A-112 and the gasket 60. The third test was conducted running the door frame heater at 100% duty cycle. The measured temperature fell below the dew point about 1⅛" (2.9 cm) from the outer corner of the doorframe, which is along the gasket 60 but still spaced apart outboard of the inner corner of the door frame by more than 1¼" (3.2 cm). Significant condensation was still observed on the exterior of the wrapper A-112 and the gasket 60.

In both FIGS. 18 and 19, the cabinet body A-12 is constructed so that the front edge margin of the wrapper A-112 is located behind the front surface of the door frame A-30, which is predominantly defined by the ferromagnetic strip A-205 of the trim breaker A-116. The inventors believe that the front edge margin of the wrapper A-112 is cooler than the ferromagnetic strip A-205. Hence, in the 100% heat test of FIG. 19, the cabinet A' produced significant condensation on the exterior of the wrapper A-112, even though the measured temperature was above the dew point temperature along a relatively wide outer segment of the door frame A-30.

Figure 20:
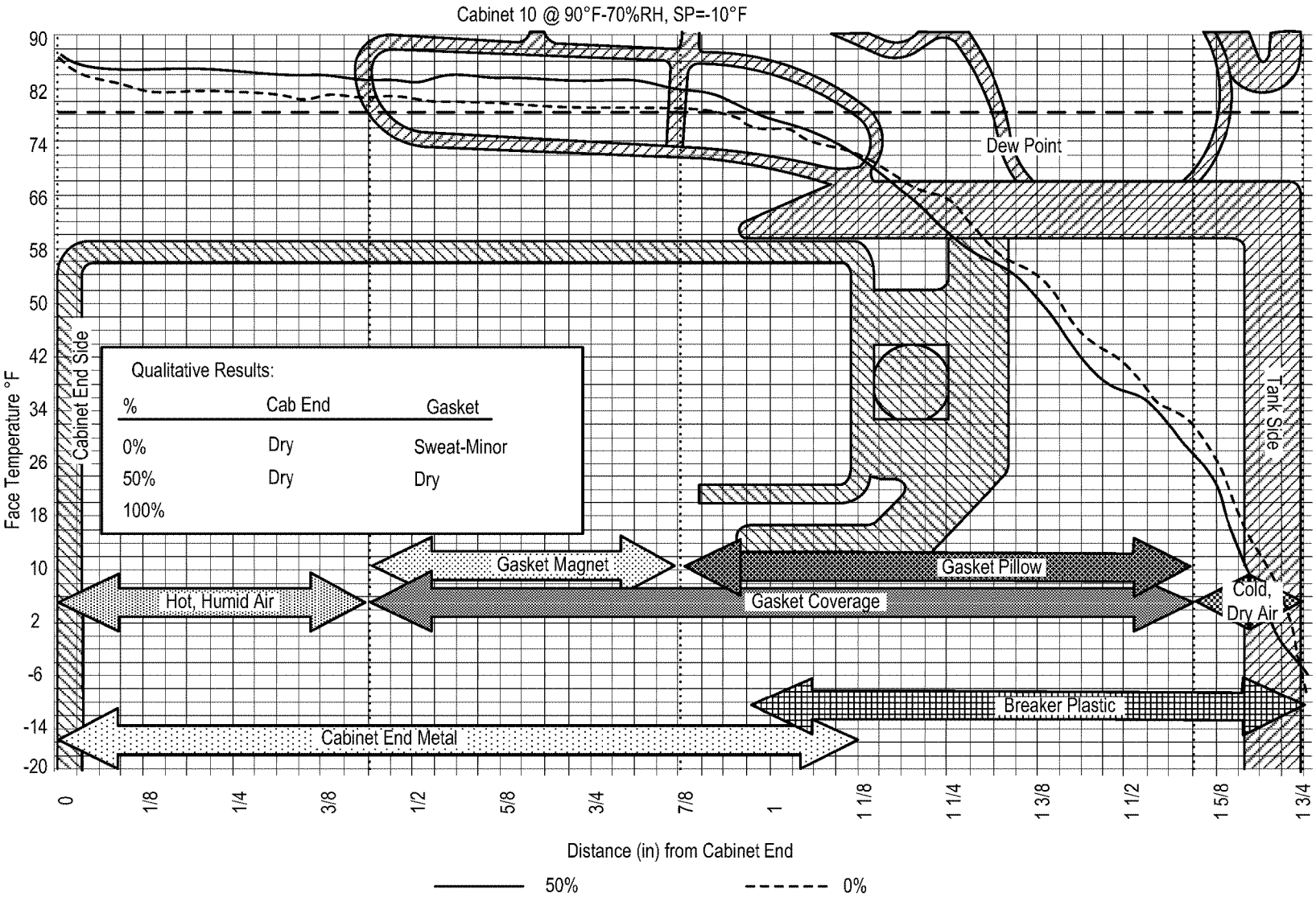
FIG. 20 is a chart superimposed on an enlarged fragmentary cross section of the door frame of FIGS. 1-10, the chart plotting door frame face temperature across the outer 1¾" (4.4 cm) thickness of the door frame after conducting climate controlled tests at ambient temperature of 90° F. (32° C.), ambient relative humidity of 70%, and cabinet set point temperature of −10° F. (−23° C.)

FIG. 20 shows the results for two tests of an exemplary embodiment of the refrigerated cabinet 10 of the present disclosure. A first test was conducted without running the door frame heater 143. The measured temperature fell below the dew point about ⅞" (2.2 cm) from the outer corner of the door frame 30, at a location on the outer sealing region SR1 with the gasket 60 and spaced apart outboard of the inner corner of the door frame 30 by about by about 1⅛" (2.9 cm). As a result, no condensation formed on the exterior of the wrapper 112 and only minor condensation was observed on the gasket 60. The second test was conducted running the door frame heater at 50% duty cycle. Measured temperature fell below the dew point more than 31/32" (2.5 cm) from the outer corner of the door frame 30, at a location slightly further inboard along the outer sealing region SR1 and spaced apart outboard of the inner corner of the door frame 30 by about 25/32" (2.0 cm). Again, no condensation formed on the exterior of the wrapper 112 and only minor condensation was observed on the gasket 60. These test results show that the refrigerated cabinet 10 provides substantially improved thermal insulation in comparison with the prior art cabinet A and the control cabinet A' fitted with the same gasket 60.

Figure 21:
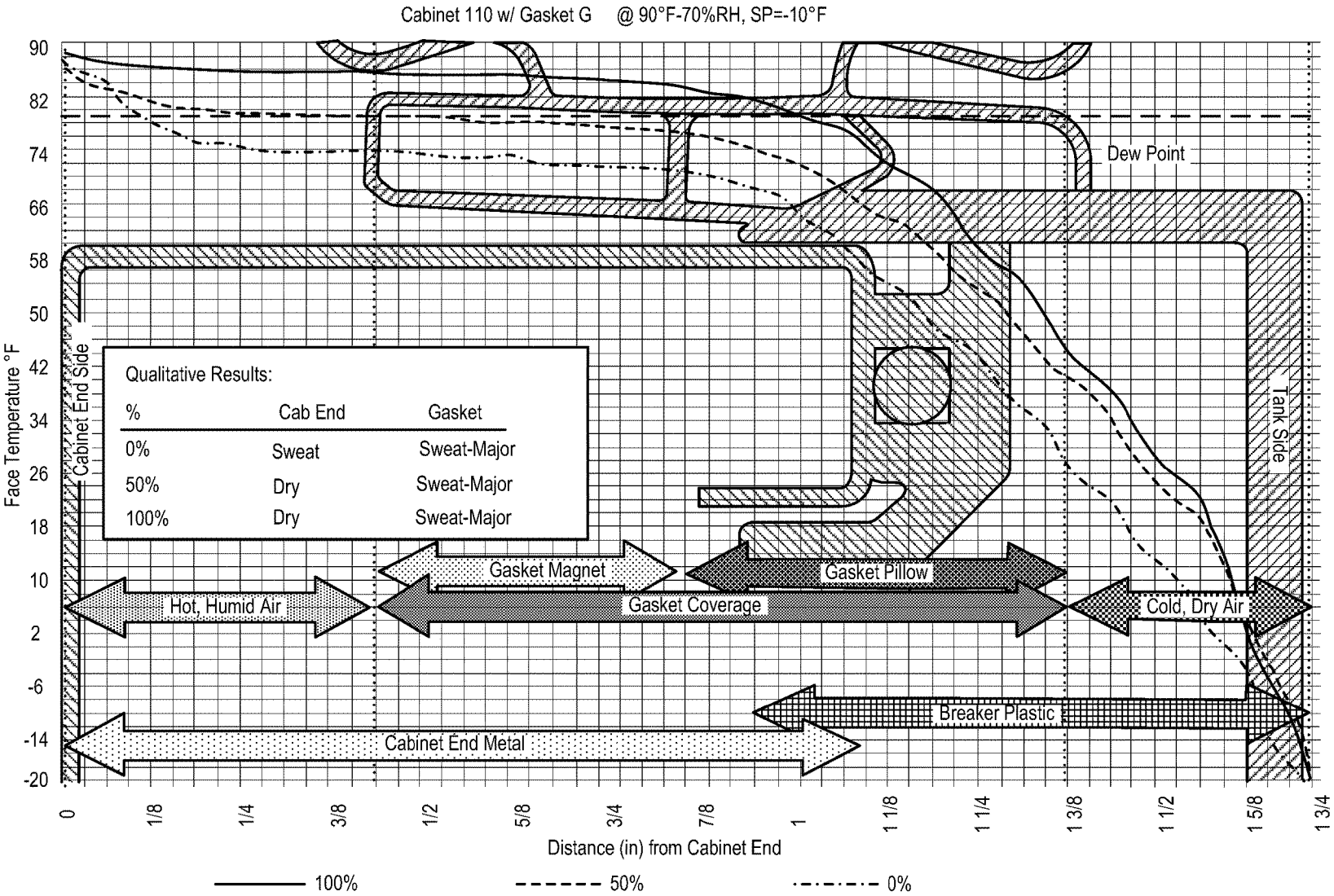
FIG. 21 is a chart superimposed on an enlarged fragmentary cross section of the door frame of FIGS. 1-10, wherein the door gasket thereof is replaced by the same door gasket used in the prior art refrigerated cabinets of FIGS. 16 and 17, the chart plotting door frame face temperature across the outer 1¾" (4.4 cm) thickness of the door frame after conducting climate controlled tests at ambient temperature of 90° F. (32° C.), ambient relative humidity of 70%, and cabinet set point temperature of −10° F. (−23° C.)

FIG. 21 shows the results for three tests that were conducted on a version of the refrigerated cabinet 10 where the gasket 60 was replaced with the more conventional gasket G. A first test was conducted without running the door frame heater 143. The measured temperature fell below the dew point about ⅛" (0.3 cm) inches from the outer corner of the door frame 30, a location about 5/16" (0.8 cm) outboard of the outer end of the gasket 60 and about 1 5/8" (4.1 cm) from the inner corner of the door frame. As a result, condensation was observed on both the exterior of the wrapper 112 and on the gasket 60. The second test was conducted running the door frame heater at 100% duty cycle. Measured temperature fell below the dew point more than 1" (2.5 cm) from the outer corner of the door frame 30 (about 25/32" (2 cm) outboard of the inner corner of the door frame), where the gasket G seals against the door frame 30. As a result, no condensation formed on the cabinet wrapper 112, though condensation was still observed on the gasket G. The third test was conducted running the door frame heater at 50% duty cycle. Measured temperature fell below the dew point more than 7/16" (1.1 cm) from the outer corner of the door frame 30 (less than 1 5/16" (3.3 cm) outboard from the inner corner of the door frame), where the gasket G seals against the door frame 30. As a result, no condensation formed on the cabinet wrapper 112, though condensation was still observed on the gasket G. These test results show that the dual-seal-region gasket 60 accounts for only part of the enhanced thermal insulation. Even when the cabinet 10 is fitted with the same gasket G as the prior art cabinets A and B, running the heater at only 50% duty cycle eliminates the condensation on the wrapper 112 at the testing conditions, whereas running the heater at 100% duty cycle in the prior art refrigerated cabinets still yielded substantial condensation on the wrapper at the testing conditions.

Table 1 below compares the qualitative observed condensation performance of the tests illustrated in FIGS. 18-21. As shown, utilizing both the novel thermal breaker 116 and the dual-seal gasket 60 yields the best condensation performance. But a portion of the improved condensation performance is clearly attributable to the novel thermal breaker 116. The thermal breaker 116 shows a clear improvement in performance vis-à-vis the prior art thermal breaker A-116. The effect of the thermal breaker can be isolated by first comparing FIGS. 21 and 18 and second comparing FIGS. 20 and 19. Comparing FIGS. 21 and 18, both cabinets subject to testing were fitted with the same gasket G, but the test cabinet 10 with thermal breaker 116 was able to operate without condensation forming on the outside of the cabinet when the heater was run at only 50% duty cycle. By contrast, condensation formed on the outside of the cabinet A even when heat was applied at a 100% duty cycle. Comparing FIGS. 20 and 19, both cabinets subject to testing were fitted with the same gasket 60, but the test cabinet 10 with thermal breaker 116 was able to operate without condensation forming on the outside of the cabinet without applying any heat to the cabinet. By contrast, condensation formed on the outside of the cabinet A' even when heat was applied at a 100% duty cycle.

TABLE 1

| | Gasket G | Gasket 60 |
|---|---|---|
| Thermal breaker 116 | FIG. 21 - no condensation on cabinet when heated at 50% duty cycle | FIG. 20 - no condensation on cabinet at 0% heat; no condensation on cabinet or gasket at 50% heat |
| Thermal breaker A-116 | FIG. 18 - condensation on cabinet and gasket at all test conditions, including when heated at 100% duty cycle | FIG. 19 - condensation on cabinet and gasket at all test conditions, including when heated at 100% duty cycle |

Figure 22:
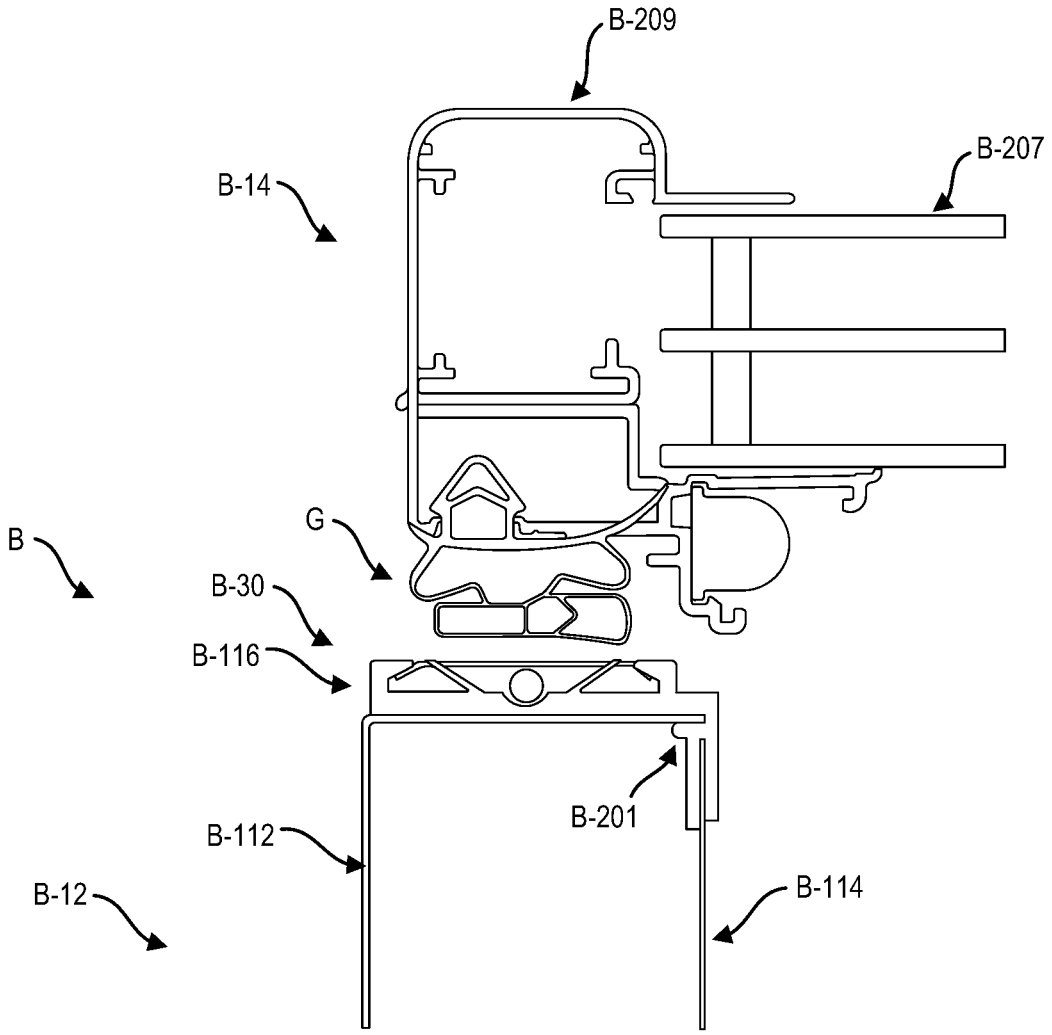
Prior Art FIG. 22
FIG. 22 is a fragmentary cross section of a door frame of another refrigerated cabinet of the prior art.

Referring to FIG. 22, another prior art cabinet tested for purposes of comparison is indicated at B. The prior art cabinet B is a glass door cabinet. The door B-14 comprises an insulated glass unit B-207 held in a frame assembly B-209 in a manner known to those skilled in the art. The glass door B-14 is configured to mount the prior art door gasket G described previously.

The cabinet body B-12 comprises a metal outer wrapper B-112, a metal inner liner B-114, and a plastic thermal breaker B-116 connecting the front edge margin of the wrapper to the front edge margin of the liner along the door frame B-30. The front edge margin of the wrapper B-112 is similar to the front edge margin of the wrapper A-112, except it extends even further inward along the wall thickness of the door frame B-30. The liner B-114 is similar to the liner of the present disclosure, but it extends further forward toward the front of the door frame B-30. The thermal breaker B-116 is similar to the thermal breaker A-116, except that it employs an L-shaped clip B-201.

Figure 23:
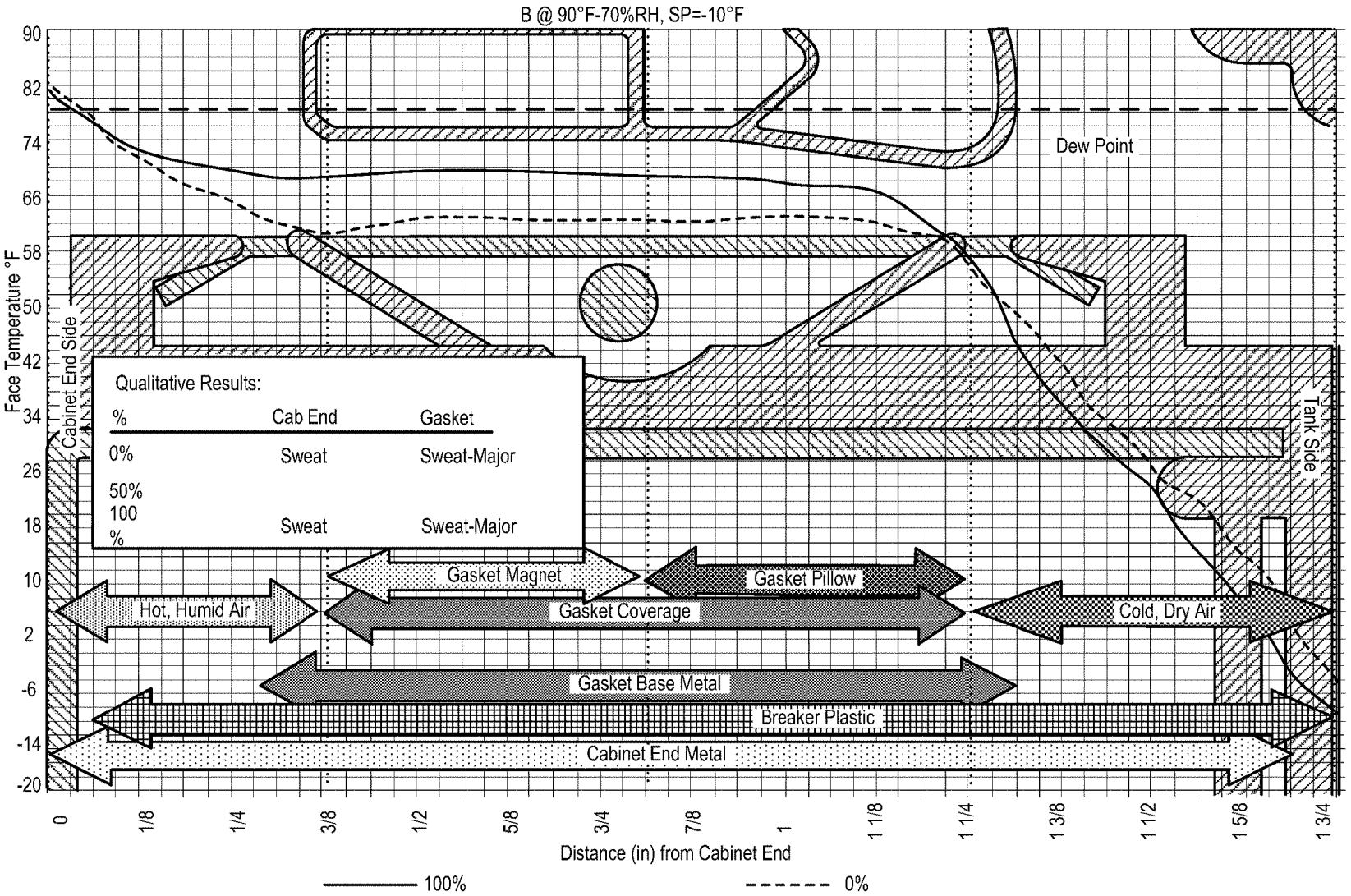
FIG. 23 is a chart superimposed on an enlarged fragmentary cross section of the door frame of the prior art refrigerated cabinet shown in FIG. 22, the chart plotting door frame face temperature across the outer 1¾" (4.4 cm) thickness of the door frame after conducting climate controlled tests at ambient temperature of 90° F. (32° C.), ambient relative humidity of 70%, and cabinet set point temperature of −10° F. (−23° C.)

FIG. 23 shows the results for two tests of the prior art cabinet B of FIG. 22. A first test was conducted without running the door frame heater. The measured temperature fell below the dew point less than 1/16" (0.6 cm) from the outer corner of the door frame, a location more than 5/16" (0.8 cm) outboard of the outer end of the gasket and about 1 11/16" (4.3 cm) outboard of the inner corner of the door frame B-30. As a result, significant condensation formed on both the exterior of the wrapper B-112 and the gasket G. The second test was conducted running the door frame heater at 100% duty cycle. Still, measured temperature fell below the dew point less than 1/16" (0.6 cm) from the outer corner of the door frame, a location more than 5/16" (0.8 cm) outboard of the outer end of the gasket G and about 1 11/16" (4.3 cm) outboard of the inner corner of the door frame B-30. So even with the door frame heater running at 100% duty cycle, significant condensation formed on both the exterior of the wrapper B-112 and the gasket G. Compare these results with the results of the tests of the cabinet 10 of the present disclosure, shown in FIGS. 20 and 21, and it will be observed that the cabinet of the present disclosure has better thermal performance and less observed condensation than the prior art cabinet B of FIG. 22.

Figure 24:
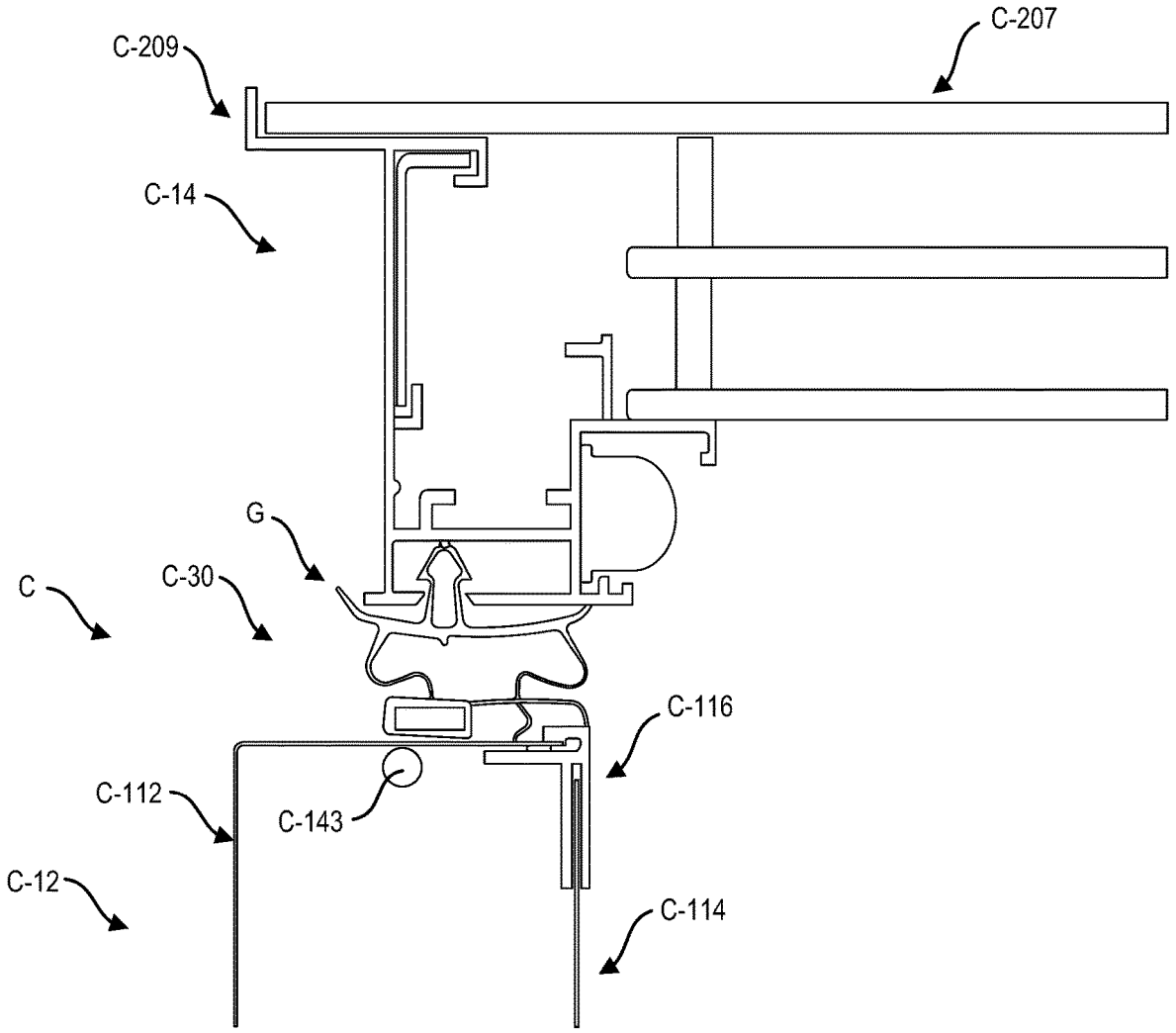
Prior Art FIG. 24
FIG. 24 is a fragmentary cross section of a door frame of another refrigerated cabinet of the prior art.

Referring to FIG. 24, another control cabinet tested for purposes of evaluating the performance of the new cabinet 10 is generally indicated at C. The control cabinet C is a glass door cabinet like cabinet B. The door C-14 comprises an insulated glass unit C-207 held in a frame assembly C-209 in a manner known to those skilled in the art. The glass door C-14 is configured to mount the prior art door gasket G described previously.

The cabinet body C-12 comprises a metal outer wrapper C-112, a metal inner liner C-114, and a plastic thermal breaker C-116 connecting the front edge margin of the wrapper to the front edge margin of the liner along the door frame C-30. The door frame C-30 has essentially the same wall thickness as the door frame 30 of the cabinet 10 of the present disclosure. In contrast with the wrapper 112 of the present disclosure, the front edge margin of the wrapper C-112 lacks the double return flange and extends further inward along the wall thickness of the door frame C-30. The frame heater C-143 is taped onto the back side of the front edge margin of the wrapper C-112. Like the liner 114, the liner C-114 has a straight front edge margin that fits into a channel at the inner/rear end of the thermal breaker C-116. But the liner C-114 extends closer to the front of the door frame C-30 than the liner 114. The thermal breaker C-116 has an L-shaped cross-sectional shape but both sections of the L-shaped thermal breaker are shorter than the corresponding sections of the L-shaped thermal breaker 116 above.

Figure 25:
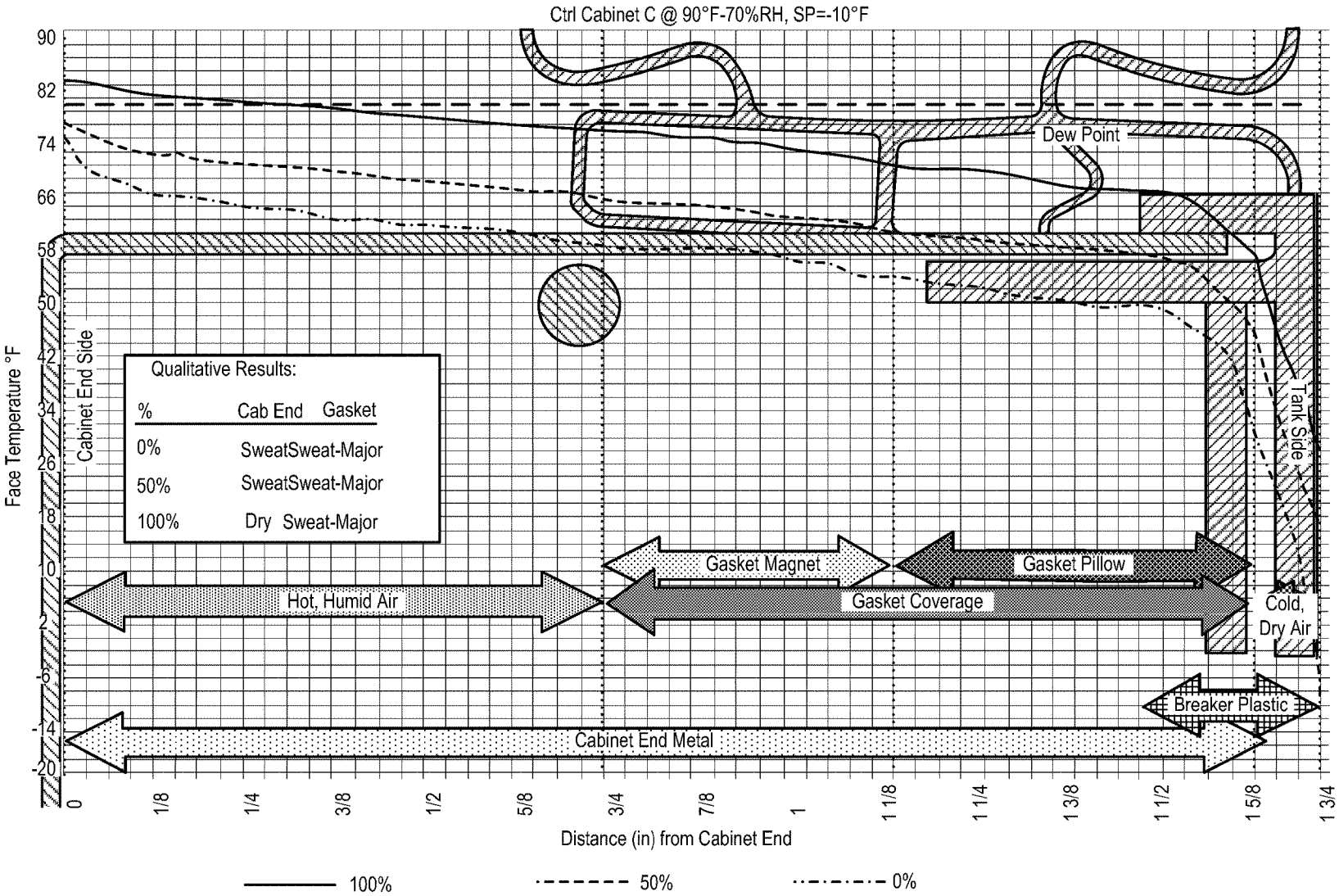
FIG. 25 is a chart superimposed on an enlarged fragmentary cross section of the door frame of the prior art refrigerated cabinet shown in FIG. 24, the chart plotting door frame face temperature across the outer 1¾" (4.4 cm) thickness of the door frame after conducting climate controlled tests at ambient temperature of 90° F. (32° C.), ambient relative humidity of 70%, and cabinet set point temperature of −10° F. (−23° C.)

FIG. 25 shows the results for three tests of the prior art cabinet C of FIG. 24. A first test was conducted without running the door frame heater C-143. The measured temperature was below the dew point temperature across the entire door frame wall thickness. As a result, significant condensation formed on both the exterior of the wrapper C-112 and the gasket G. The second test was conducted running the door frame heater C-143 at 50% duty cycle. Again, the measured temperature was below the dew point temperature across the entire door frame wall thickness and significant condensation was observed on both the exterior of the wrapper C-112 and the gasket G. In the third test, the door frame heater C-143 operated at 100% duty cycle, and the measured temperature fell below the dew point about ¼" (0.6 cm) from the outer corner of the door frame. No condensation was observed on the exterior of the wrapper C-112 when the heater was operated at 100% duty cycle. Comparing these results with the results of the tests of the cabinet 10 of the present disclosure, as shown in FIGS. 20 and 21, it is apparent that the cabinet of the present disclosure has better thermal performance and less observed condensation than the control cabinet C of FIG. 24.

Figure 26:
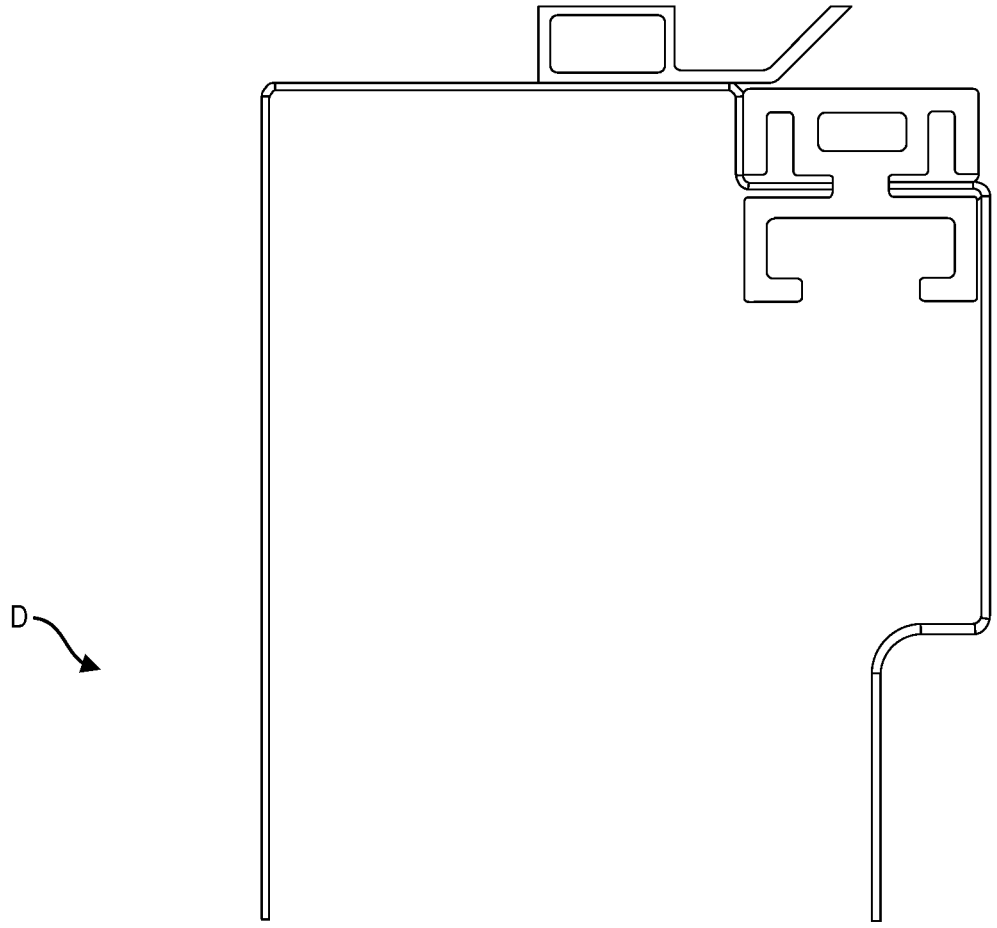
Prior Art FIG. 26
FIG. 26 is a schematic fragmentary cross section of a door frame of a prior art M3 freezer, sold by Turbo Air.
Figure 27:
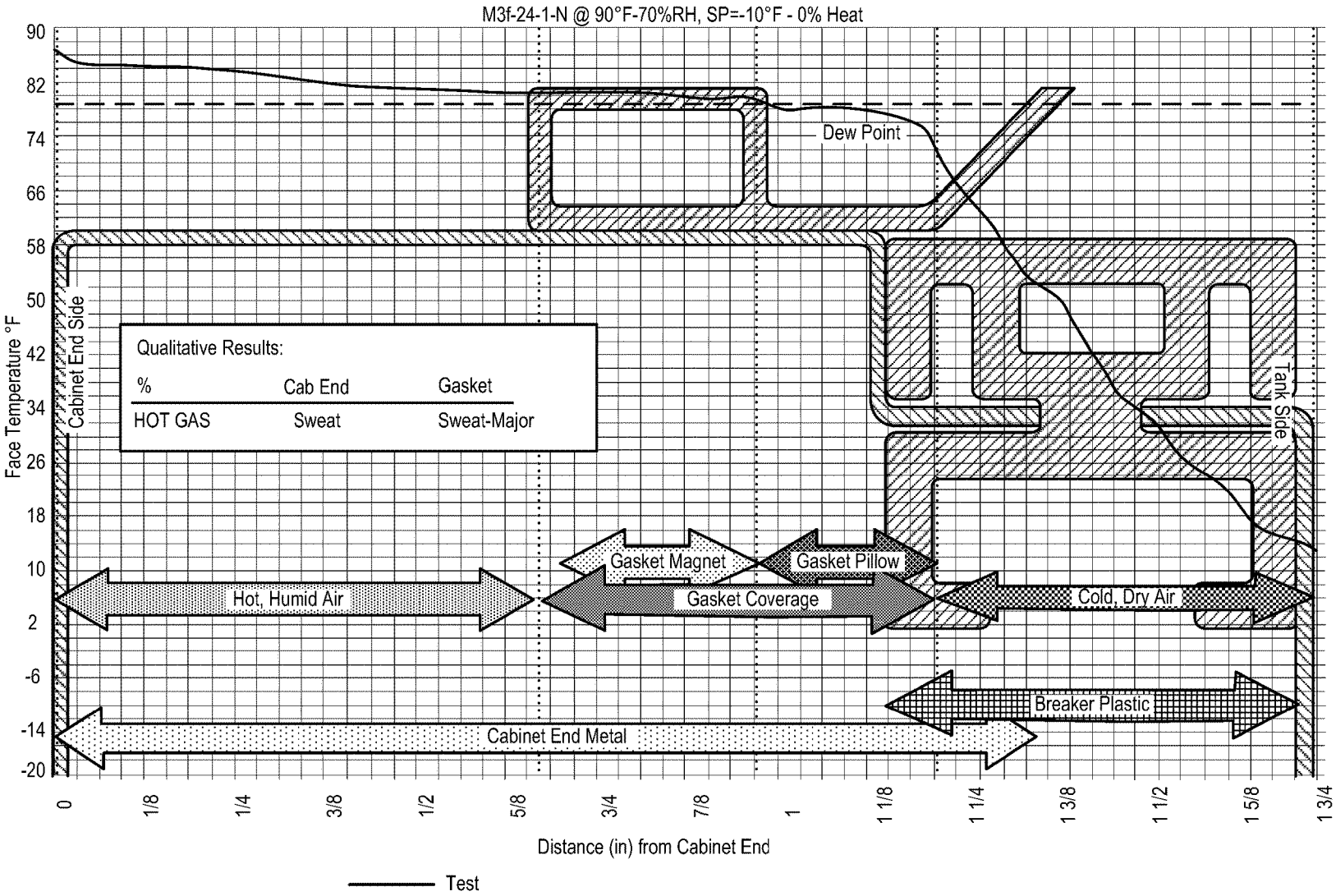
FIG. 27 is a chart superimposed on an enlarged fragmentary cross section of the door frame of the prior art refrigerated cabinet shown in FIG. 26, the chart plotting door frame face temperature across the outer 1¾" (4.4 cm) thickness of the door frame after conducting climate controlled tests at ambient temperature of 90° F. (32° C.), ambient relative humidity of 70%, and cabinet set point temperature of −10° F. (−23° C.)

Referring to FIGS. 26-27, another test was conducted on a commercially available M3F freezer, sold by Turbo Air, which is shown schematically in FIG. 26 at D. The M3F freezer D has a very thick door frame. As shown in FIG. 27 the door frame of the M3F freezer D is about 2 3/16" (5.6 cm). FIG. 27 shows the results for a test of the M3F freezer D. The test was conducted without applying any electric door heat. But the door frame of the M3F freezer is heated by a hot gas loop (not shown) that provides heat whenever the refrigeration system is running. In the test, the measured temperature fell below the dew point about 1 7/32" (3.1 cm) from the outer corner of the door frame. But since the door frame of the M3F freezer is much thicker than the door frame 30 of the cabinet 10, this location approximately 1" (2.5 cm) outboard of the inner corner of the door frame. By way of comparison, as shown in FIG. 20, location at which the door frame 30 of the cabinet 10 of the present disclosure fell below the dew point with 0% heat was only ⅞" (2.2 cm) outboard of the inner corner of the door frame. The location at which the door frame 30 of the cabinet 10 of the present disclosure fell below the dew point with 50% heat was only ¾" (1.9 cm) outboard of the inner corner of the door frame. Qualitatively, notable condensation was observed on the exterior of the cabinet D upon completion of the test at ambient conditions of 90° F. (32° C.) and 70% relative humidity and a freezer set point temperature of −10° F. (−23° C.).

Figure 28:
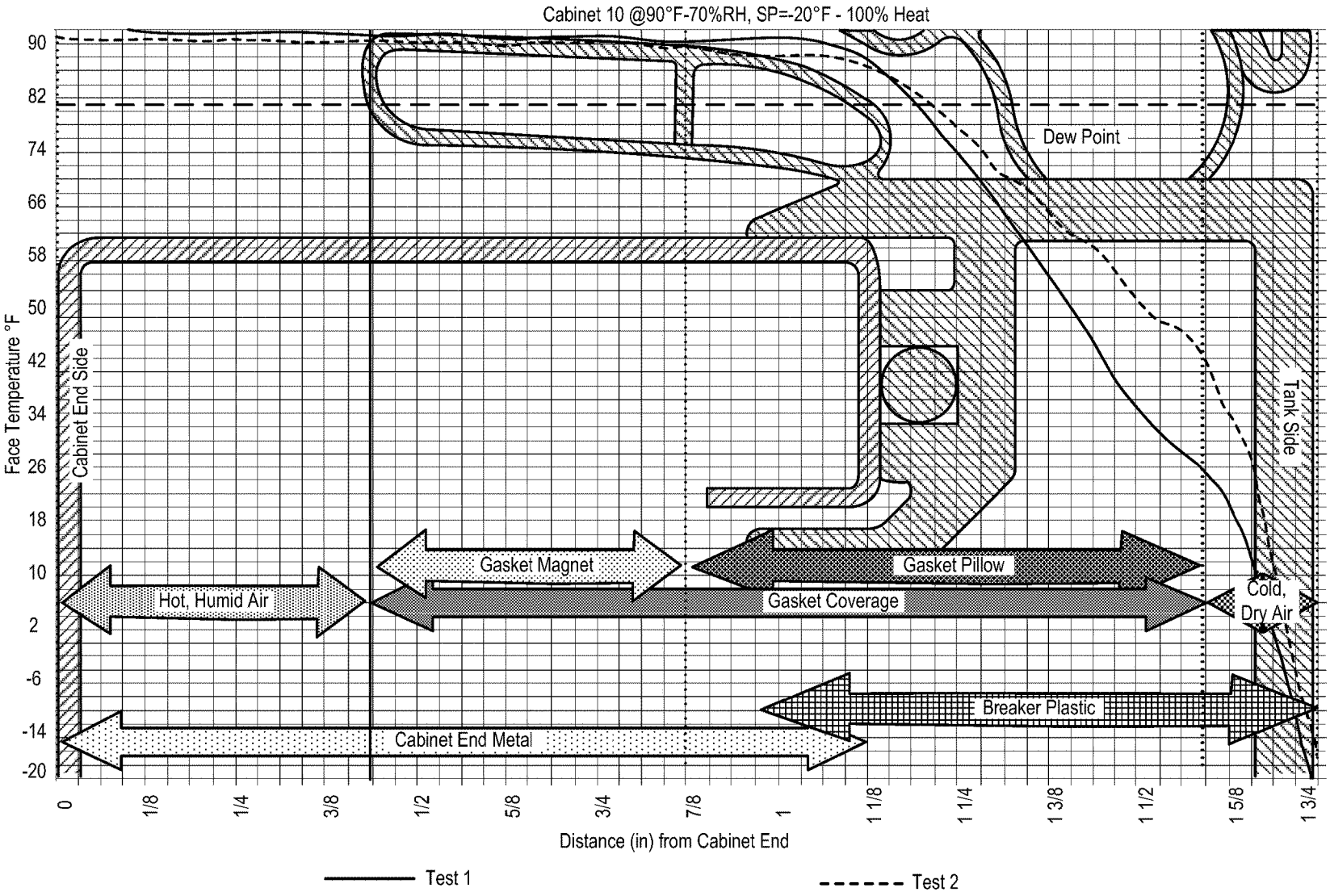
FIG. 28 is a chart superimposed on an enlarged fragmentary cross section of the door frame of FIGS. 1-10, the chart plotting door frame face temperature across the outer 1¾" (4.4 cm) thickness of the door frame after conducting climate controlled tests at ambient temperature of 90° F.) (32° C., ambient relative humidity of 70%, and cabinet set point temperature of −20° F. (−29° C.).

Referring to FIG. 28, another two tests were conducted on the cabinet 10 of the present disclosure at the same climate control chamber conditions (ambient conditions of 90° F. (32° C.) and 70% relative humidity), but with the refrigerated cabinet 10 running at a set point temperature of −20° F. (−29° C.) and the frame heater running at 100% duty cycle. As shown in FIG. 22, in both tests, the measured temperature fell below the dew point more than 1⅛" (2.9 cm) from the outer corner of the door frame 30, between the outer sealing region SR1 and the inner sealing region SR2. No condensation was observed on the wrapper 12 after either test. Those skilled in the art will recognize that the test conditions in FIG. 22 are extremely onerous for commercial refrigerated cabinets and that the results depicted in FIG. 22 show that the refrigerated cabinet 10 is providing exceptional thermal insulation.

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the disclosure are achieved and other advantageous results attained.

As various changes could be made in the above products and methods without departing from the scope of the disclosure, it is intended that all matter contained in the above description shall be interpreted as illustrative and not in a limiting sense.

What is claimed is:

1. A refrigerated cabinet comprising:

a cabinet body defining an interior and having a door frame defining a doorway for providing access to the interior from an exterior of the refrigerated cabinet, the cabinet body comprising:

a wrapper having a front edge margin adjacent the doorway;

a liner having a front edge margin adjacent the doorway; and a thermal breaker having an outer interface connected to the front edge margin of the wrapper and an inner interface connected to the front edge margin of the liner whereby the thermal breaker connects the front edge margin of the wrapper to the front edge margin of the liner and provides a thermal break between the front edge margin of the wrapper and the front edge margin of the liner; and a door connected to the cabinet body for movement in relation to the cabinet body between an opened position and a closed position, the door comprising a gasket configured to seal against the door frame in the closed position, the gasket comprising an inner sealing element and an outer sealing element, the inner sealing element configured to seal against the thermal breaker and the outer sealing element configured to seal against the front edge margin of the wrapper when the door is in the closed position;

wherein the outer interface has an outer front edge and wherein the inner sealing element is configured to seal against the thermal breaker along a sealing region that is inwardly spaced from the outer front edge such that sealing contact between the inner sealing element and the cabinet body is localized to the thermal breaker.

2. The refrigerated cabinet as set forth in claim 1, wherein the wrapper and the thermal breaker each define a respective forward facing surface, the inner sealing element configured to seal against the forward facing surface of the thermal breaker and the outer sealing element configured to seal against the forward facing surface of the wrapper.

3. The refrigerated cabinet as set forth in claim 1, wherein the thermal breaker has generally L-shaped cross-sectional shape including a front/outer section that defines a forward facing door frame surface and a rear/inner section generally perpendicular to the front/outer section.

4. The refrigerated cabinet as set forth in claim 3, wherein the front/outer section defines the outer interface and the rear/inner section defines the inner interface.

5. The refrigerated cabinet as set forth in claim 4, wherein the front edge margin of the wrapper comprises a double return flange and the outer interface comprises a channel configured to receive the double return flange.

6. The refrigerated cabinet as set forth in claim 5, wherein the channel has a front section, a back section, an inner section extending from the front section to the back section, and an open outer end opposite the inner section extending between the front section and the back section.

7. The refrigerated cabinet as set forth in claim 6, wherein the double return flange comprises a front section, a back section, and an inner section extending from the front section to the back section such that the front section and the back section both extend outward from the inner section.

8. The refrigerated cabinet as set forth in claim 4, wherein the front edge margin of the liner comprises a forward-facing edge and a plurality of spaced apart protrusions adjacent the forward facing edge.

9. The refrigerated cabinet as set forth in claim 8, wherein the inner interface comprises a channel configured to receive the forward facing edge and to engage the plurality of spaced apart protrusions by snap-fit.

10. The refrigerated cabinet as set forth in claim 3, wherein the front/outer section has a first corner-to-tip dimension and the rear/inner section has a second corner-to-tip dimension greater than the first corner-to-tip dimension.

11. The refrigerated cabinet as set forth in claim 10, wherein the second corner-to-tip dimension is at least 1.5-times the first corner-to-tip dimension.

12. The refrigerated cabinet as set forth in claim 1, wherein the wrapper is stainless steel.

13. The refrigerated cabinet as set forth in claim 1, wherein the cabinet body has a wall thickness and wherein the thermal breaker is configured to couple to the wrapper on an inner half of the wall thickness.

14. A refrigerated cabinet comprising:

a cabinet body defining an interior and having a door frame defining a doorway for providing access to the interior from an exterior of the refrigerated cabinet, the cabinet body comprising:

a wrapper having a front edge margin adjacent the doorway;

a liner having a front edge margin adjacent the doorway; and a thermal breaker having an outer interface connected to the front edge margin of the wrapper and an inner interface connected to the front edge margin of the liner whereby the thermal breaker connects the front edge margin of the wrapper to the front edge margin of the liner and provides a thermal break between the front edge margin of the wrapper and the front edge margin of the liner; and a door connected to the cabinet body for movement in relation to the cabinet body between an opened position and a closed position, the door comprising a gasket configured to seal against the door frame in the closed position, the gasket comprising an inner sealing element and an outer sealing element, the inner sealing element configured to seal against the thermal breaker and the outer sealing element configured to seal against the front edge margin of the wrapper when the door is in the closed position;

wherein the thermal breaker has generally L-shaped cross-sectional shape including a front/outer section that defines a forward facing door frame surface and a rear/inner section generally perpendicular to the front/outer section;

wherein the front/outer section defines the outer interface and the rear/inner section defines the inner interface;

wherein the front edge margin of the wrapper comprises a double return flange and the outer interface comprises a channel configured to receive the double return flange;

wherein the channel has a front section, a back section, an inner section extending from the front section to the back section, and an open outer end opposite the inner section extending between the front section and the back section;

wherein the double return flange comprises a front section, a back section, and an inner section extending from the front section to the back section such that the front section and the back section both extend outward from the inner section;

the refrigerated cabinet further comprising a frame heater between the inner section of the channel and the inner section of the double return flange.

15. A refrigerated cabinet comprising:

a cabinet body defining an interior and having a door frame defining a doorway for providing access to the interior from an exterior of the refrigerated cabinet, the cabinet body comprising:

a wrapper having a front edge margin adjacent the doorway;

a liner having a front edge margin adjacent the doorway; and a thermal breaker having an outer interface connected to the front edge margin of the wrapper and an inner interface connected to the front edge margin of the liner whereby the thermal breaker connects the front edge margin of the wrapper to the front edge margin of the liner and provides a thermal break between the front edge margin of the wrapper and the front edge margin of the liner; and a door connected to the cabinet body for movement in relation to the cabinet body between an opened position and a closed position, the door comprising a gasket configured to seal against the door frame in the closed position, the gasket comprising an inner sealing element and an outer sealing element, the inner sealing element configured to seal against the thermal breaker and the outer sealing element configured to seal against the front edge margin of the wrapper when the door is in the closed position;

wherein the thermal breaker has generally L-shaped cross-sectional shape including a front/outer section that defines a forward facing door frame surface and a rear/inner section generally perpendicular to the front/outer section;

wherein the front/outer section defines the outer interface and the rear/inner section defines the inner interface;

wherein the front edge margin of the wrapper comprises a double return flange and the outer interface comprises a channel configured to receive the double return flange;

wherein the channel has a front section, a back section, an inner section extending from the front section to the back section, and an open outer end opposite the inner section extending between the front section and the back section;

wherein the double return flange comprises a front section, a back section, and an inner section extending from the front section to the back section such that the front section and the back section both extend outward from the inner section;

wherein the channel further comprises first and second interior legs extending outward from the inner section to define a heating element duct.

16. The refrigerated cabinet as set forth in claim 15, wherein no portion of the wrapper is in front of the heating element duct.

17. The refrigerated cabinet as set forth in claim 15, wherein the heating element duct is spaced apart inward of an outer sealing region of the door frame where the outer sealing element is configured to seal against the front edge margin of the wrapper.

18. A refrigerated cabinet comprising:

a cabinet body defining an interior and having a door frame defining a doorway for providing access to the interior from an exterior of the refrigerated cabinet, the cabinet body comprising:

a wrapper having a front edge margin adjacent the doorway;

a liner having a front edge margin adjacent the doorway; and a thermal breaker having an outer interface connected to the front edge margin of the wrapper and an inner interface connected to the front edge margin of the liner whereby the thermal breaker connects the front edge margin of the wrapper to the front edge margin of the liner and provides a thermal break between the front edge margin of the wrapper and the front edge margin of the liner; and a door connected to the cabinet body for movement in relation to the cabinet body between an opened position and a closed position, the door comprising a gasket configured to seal against the door frame in the closed position, the gasket comprising an inner sealing element and an outer sealing element, the inner sealing element configured to seal against the thermal breaker and the outer sealing element configured to seal against the front edge margin of the wrapper when the door is in the closed position;

the refrigerated cabinet further comprising a refrigeration system configured to maintain a −10° F. (−23° C.) set point in the interior of the cabinet body, the refrigerated cabinet configured to prevent condensation from forming at the door frame when the refrigeration system maintains the −10° F. (−23° C.) set point in ambient conditions of at least 90° F. (32° C.) and at least 70% relative humidity without heating the door frame.

19. A refrigerated cabinet comprising:

a cabinet body defining an interior and having a door frame defining a doorway for providing access to the interior from an exterior of the refrigerated cabinet, the cabinet body comprising:

a wrapper having a front edge margin adjacent the doorway;

a liner having a front edge margin adjacent the doorway; and a thermal breaker having an outer interface connected to the front edge margin of the wrapper and an inner interface connected to the front edge margin of the liner whereby the thermal breaker connects the front edge margin of the wrapper to the front edge margin of the liner and provides a thermal break between the front edge margin of the wrapper and the front edge margin of the liner; and a door connected to the cabinet body for movement in relation to the cabinet body between an opened position and a closed position, the door comprising a gasket configured to seal against the door frame in the closed position, the gasket comprising an inner sealing element and an outer sealing element, the inner sealing element configured to seal against the thermal breaker and the outer sealing element configured to seal against the front edge margin of the wrapper when the door is in the closed position;

the refrigerated cabinet further comprising a refrigeration system configured to maintain a −20° F. (−29° C.) set point in the interior of the cabinet body, the refrigerated cabinet configured to prevent condensation from forming at the door frame when the refrigeration system maintains the −20° F. (−29° C.) set point in ambient conditions of at least 90° F. (32° C.) and at least 70% relative humidity when a heating wire along the door frame operates at 1.7 W/ft (5.6 W/m) and 100% duty cycle.

20. A refrigerated cabinet comprising:

a cabinet body defining an interior and having a door frame defining a doorway for providing access to the interior from an exterior of the refrigerated cabinet, the cabinet body comprising:

a wrapper having a front edge margin adjacent the doorway, the front edge margin including a double return flange, wherein the double return flange comprises a front section, a back section, and an inner section extending from the front section to the back section such that the double return flange defines a gap between the front section and the back section, the front section and the back section both extending outward from the inner section;

a liner having a front edge margin adjacent the doorway; and a thermal breaker having an outer interface connected to the front edge margin of the wrapper and an inner interface connected to the front edge margin of the liner whereby the thermal breaker connects the front edge margin of the wrapper to the front edge margin of the liner and provides a thermal break between the front edge margin of the wrapper and the front edge margin of the liner; and a door connected to the cabinet body for movement in relation to the cabinet body between an opened position and a closed position, the door comprising a gasket configured to seal against the door frame in the closed position;

wherein the outer interface comprises a channel receiving the double return flange such that the double return flange nests within the channel.

* * * * *